US011002039B2

(12) United States Patent
Roatis et al.

(10) Patent No.: US 11,002,039 B2
(45) Date of Patent: May 11, 2021

(54) ELECTRONIC CONTROLLED HANDLES

(71) Applicant: TriTeq Lock and Security LLC, Elk Grove Village, IL (US)

(72) Inventors: Calin Roatis, Long Grove, IL (US); Gabriel Ribu, Niles, IL (US); William Denison, North Barrington, IL (US)

(73) Assignee: Triteq Lock and Security, L.L.C., Elk Grove Village, IL (US)

( * ) Notice: Subject to any disclaimer, the term of this patent is extended or adjusted under 35 U.S.C. 154(b) by 904 days.

(21) Appl. No.: 13/866,525

(22) Filed: Apr. 19, 2013

(65) Prior Publication Data

US 2013/0285393 A1 Oct. 31, 2013

Related U.S. Application Data

(60) Provisional application No. 61/636,263, filed on Apr. 20, 2012.

(51) Int. Cl.

| | |
|---|---|
| ***E05B 5/02*** | (2006.01) |
| ***E05B 47/06*** | (2006.01) |
| ***E05B 1/00*** | (2006.01) |
| ***E05B 47/00*** | (2006.01) |
| ***E05B 7/00*** | (2006.01) |
| *E05C 3/06* | (2006.01) |

(52) U.S. Cl.

CPC ..... *E05B 1/003* (2013.01); *E05B 5/003* (2013.01); *E05B 7/00* (2013.01); *E05B 47/0012* (2013.01); *E05B 47/0657* (2013.01); *E05B 47/0673* (2013.01); *E05B 2047/0024* (2013.01); *E05B 2047/0067* (2013.01); *E05B 2047/0091* (2013.01); *E05B 2047/0093* (2013.01); *E05B 2047/0094* (2013.01); *E05C 3/06* (2013.01); *Y10T 292/57* (2015.04)

(58) Field of Classification Search

CPC ..... E05B 5/00; E05B 13/00

USPC .... 292/144, 336.3, 347; 70/208, 210, 278.7, 70/279.1, 283.1, 432

See application file for complete search history.

(56) References Cited

U.S. PATENT DOCUMENTS

| | | | | |
|---|---|---|---|---|
| 1,370,190 | A * | 3/1921 | Cook | B60R 25/02126 70/185 |
| 1,875,768 | A | 9/1932 | Smith | |
| 1,907,625 | A | 5/1933 | Vogt | |
| 2,269,264 | A | 1/1942 | Haim | |
| 2,703,431 | A | 3/1955 | Tatom | |
| 2,741,503 | A | 4/1956 | Thompson | |
| 2,753,202 | A | 7/1956 | Smith et al. | |
| 2,833,536 | A | 5/1958 | Joachim et al. | |
| 2,877,637 | A | 3/1959 | Greenwald | |
| 2,896,990 | A | 7/1959 | Garvey et al. | |
| 2,903,288 | A | 9/1959 | Joachim et al. | |
| 2,943,880 | A | 7/1960 | Joachim et al. | |
| 2,978,266 | A | 4/1961 | Poe | |
| 3,080,633 | A | 3/1963 | Reddy | |
| 3,081,078 | A | 3/1963 | Lohr | |

(Continued)

FOREIGN PATENT DOCUMENTS

| | | |
|---|---|---|
| JP | 02-091371 | 3/1990 |

*Primary Examiner* — Carlos Lugo

(74) *Attorney, Agent, or Firm* — Charles T. Riggs, Jr.

(57) ABSTRACT

In accordance with an embodiment, electronic control is provided for the locking function of Lift-Handle and T-Handle products, while maintaining desirable mechanical latching mechanism functions and operations.

12 Claims, 26 Drawing Sheets

(56) References Cited

U.S. PATENT DOCUMENTS 3,089,330 A 5/1963 Kerr
3,200,623 A 8/1965 Peters
3,285,043 A * 11/1966 Dauenbaugh ..... E05B 5/003 70/208
3,302,434 A * 2/1967 Dauenhaugh ..... E05B 5/003 292/251
3,438,227 A * 4/1969 Wolniak ..... E05B 5/003 70/208
3,548,618 A * 12/1970 Dauenbaugh ..... E05B 5/003 70/208
3,550,412 A 12/1970 Pitel et al.
3,594,876 A 7/1971 Gunther
3,688,352 A 9/1972 Gunther
3,834,198 A * 9/1974 Wiczer ..... E05B 5/003 292/169
3,835,678 A 9/1974 Meyer et al.
3,854,310 A 12/1974 Paull et al.
3,947,060 A 3/1976 Zimmer et al.
4,159,138 A 6/1979 Smith
4,167,104 A 9/1979 Bond
4,213,230 A 7/1980 Hoen
4,227,723 A 10/1980 Rosell
4,268,076 A 5/1981 Itol
4,300,664 A 11/1981 Helm et al.
4,355,830 A 10/1982 Rau, III
4,411,544 A 10/1983 Gallman
4,552,001 A 11/1985 Roop
4,556,244 A 12/1985 Bisbing
4,583,775 A 4/1986 Bisbing
4,594,637 A 6/1986 Falk
4,609,215 A 9/1986 Self et al.
4,671,547 A 8/1987 Weinerman et al.
4,685,709 A 8/1987 Kambic
4,689,976 A * 9/1987 Larsen ..... E05B 5/003 70/140
4,744,392 A 5/1988 Tade et al.
4,760,721 A 8/1988 Steinbech
4,762,348 A 8/1988 Matssumoto et al.
4,796,932 A 1/1989 Tame
4,803,460 A 2/1989 Rhee et al.
4,819,983 A 4/1989 Alexander et al.
4,838,055 A * 6/1989 Gallagher ..... E05B 5/003 70/208
4,842,313 A 6/1989 Boyko et al.
4,906,035 A 3/1990 Nalgai et al.
4,917,022 A 4/1990 Ogasawara et al.
4,899,581 A 12/1990 Myers
4,993,247 A 2/1991 Minemura
5,035,452 A 7/1991 Rogers
5,038,588 A * 8/1991 Hall ..... E05B 5/003 70/208
5,054,300 A 10/1991 Nakahara et al.
5,106,251 A 4/1992 Steinbach
5,148,691 A 9/1992 Wallden
5,160,180 A 11/1992 Mlynarczyk
5,186,516 A 2/1993 Alexander et al.
5,199,288 A 4/1993 Merilainen et al.
5,269,161 A 12/1993 Stillwagon
5,272,894 A 12/1993 Stillwagon et al.
5,349,345 A 9/1994 Vanderschel
5,394,718 A 3/1995 Hotzl
5,467,619 A 11/1995 Stillwagon et al.
5,548,982 A 8/1996 Rawling
5,561,420 A * 10/1996 Kleefeldt ..... E05B 77/48 307/10.5
5,575,515 A 11/1996 Iwamoto et al.
5,586,459 A * 12/1996 Bullock ..... E05B 13/108 70/210
5,617,082 A 4/1997 Denison et al.
5,618,082 A 4/1997 Jachmich
5,636,881 A 6/1997 Stillwagon
5,639,130 A 6/1997 Rogers et al.
5,656,867 A 8/1997 Kokubu et al.
5,680,783 A 10/1997 Kuroda et al.
5,782,384 A 6/1998 Bartel
5,791,179 A 8/1998 Brask
5,793,122 A 8/1998 Dingwall
5,813,257 A 9/1998 Cleghorn et al.
5,823,027 A 10/1998 Glick et al.
5,836,187 A * 11/1998 Janssen ..... B60R 25/04 70/252
5,839,305 A * 11/1998 Aston ..... E05B 47/0615 70/283.1
5,862,693 A 1/1999 Myers et al.
5,870,915 A * 2/1999 D'Hont ..... E05B 47/063 70/277
5,882,053 A * 3/1999 Bekins ..... E05B 1/003 292/336.3
5,915,766 A 6/1999 Baumeister et al.
5,921,119 A 7/1999 Myers et al.
6,005,487 A 12/1999 Myers et al.
6,046,681 A 4/2000 Solop
6,049,287 A 4/2000 Yulkowski
6,068,305 A 5/2000 Myers et al.
6,068,308 A 5/2000 Molzer
6,068,487 A 5/2000 Dionne
6,106,035 A 8/2000 Hetherington
6,130,611 A 10/2000 Pellaton et al.
6,196,037 B1 3/2001 Urschel et al.
6,256,932 B1 7/2001 Jyawook et al.
6,318,138 B1 * 11/2001 Mathews ..... E05B 47/0012 292/144
6,341,448 B1 1/2002 Murray et al.
6,345,522 B1 2/2002 Stillwagon et al.
6,360,573 B1 3/2002 Ming-Chih
6,370,928 B1 4/2002 Chies et al.
6,374,649 B1 4/2002 Holcomb et al.
6,382,003 B1 * 5/2002 Watanuki ..... B60R 25/04 70/184
6,406,071 B1 6/2002 La Viola et al.
6,442,986 B1 * 9/2002 Russell ..... E05B 47/063 70/278.3
6,474,119 B1 11/2002 Halvorson et al.
6,490,896 B2 12/2002 Segawa
6,496,101 B1 12/2002 Stillwagon
6,525,644 B1 2/2003 Stillwagon
6,543,264 B2 4/2003 Frolov
6,564,600 B1 5/2003 Davis
6,575,504 B2 6/2003 Roatis et al.
6,580,355 B1 6/2003 Milo
6,581,986 B2 6/2003 Roatis et al.
6,609,402 B2 * 8/2003 Blankenship ..... G07C 9/00944 70/278.2
6,615,623 B1 9/2003 Ormerod
6,684,671 B2 2/2004 Beylotte et al.
6,826,935 B2 * 12/2004 Gokcebay ..... G06K 19/04 340/5.2
6,867,685 B1 3/2005 Stillwagon
6,874,828 B2 4/2005 Roatis et al.
7,073,827 B2 7/2006 Cherry
7,089,770 B2 8/2006 Ramsauer et al.
7,145,434 B2 12/2006 Mlynarczyk et al.
7,191,624 B2 3/2007 Beylotte et al.
7,296,447 B2 11/2007 Priest et al.
7,469,564 B1 * 12/2008 Shaw ..... E05B 9/08 292/144
7,681,424 B2 3/2010 Antonucci
7,845,202 B2 * 12/2010 Padilla ..... E05B 9/086 70/278.1
2002/0078722 A1 * 6/2002 Corey ..... E05B 15/1614 70/208
2003/0127866 A1 7/2003 Martinez et al.
2004/0154363 A1 8/2004 Beylotte et al.
2004/0172991 A1 9/2004 Forster et al.
2005/0161953 A1 7/2005 Roatis et al.
2006/0186678 A1 8/2006 Myers et al.

* cited by examiner

FIG. 4A
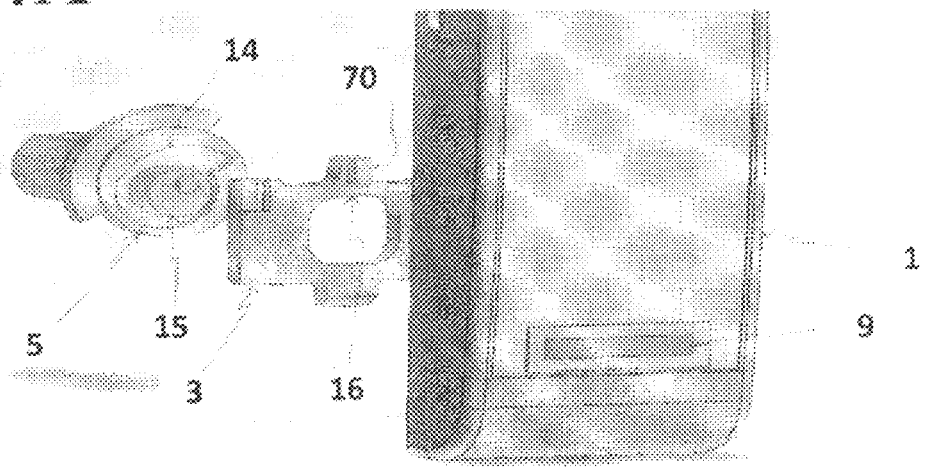
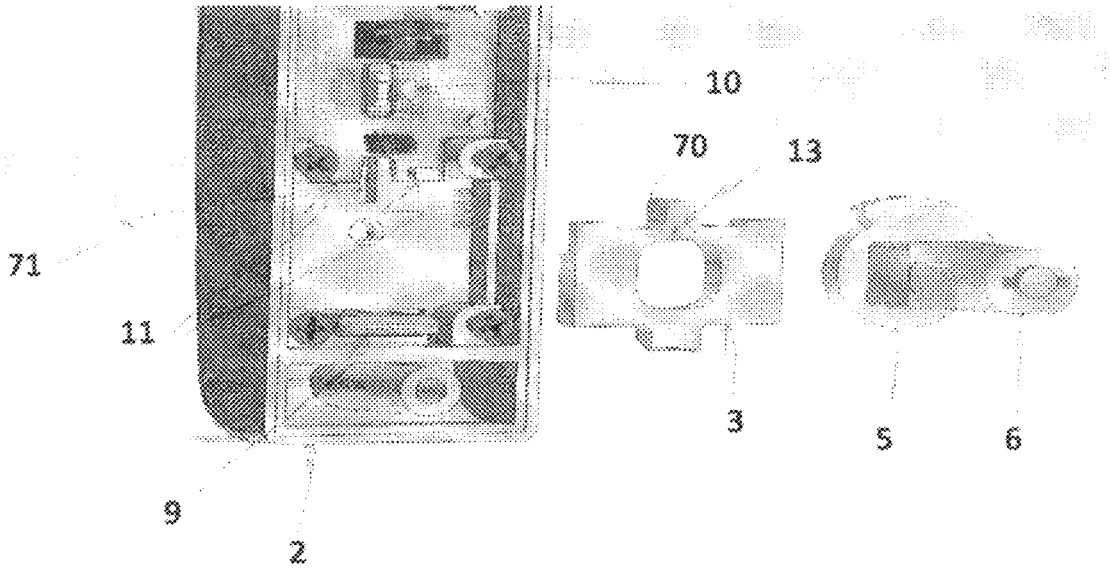
FIG. 4B

LATCHED Handle Out

LATCHED Handle In

Unlocked to Latched

FIG. 14
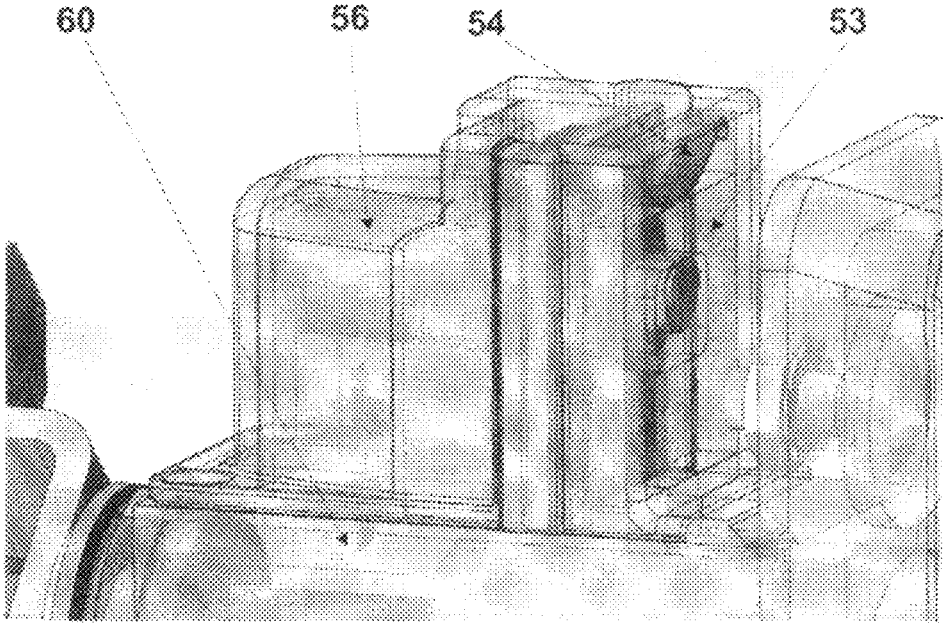
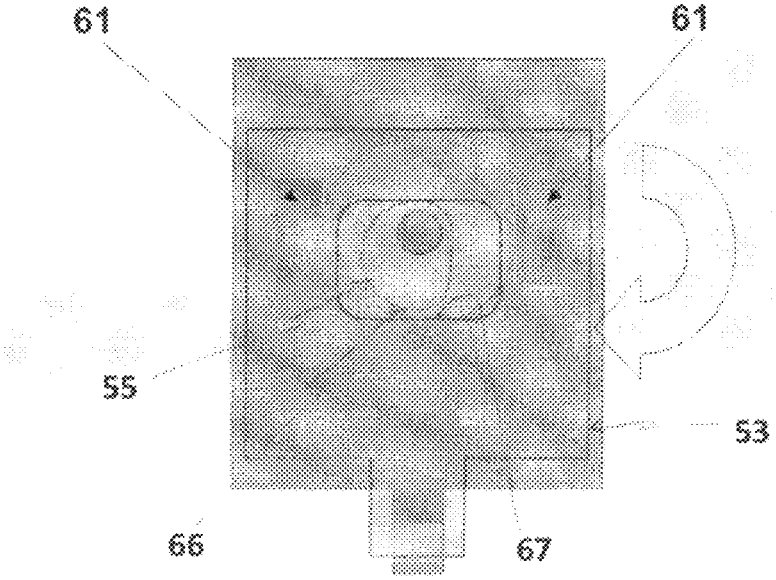
FIG. 15

S1 – 1, S2 – 0, SH – 1

LOCKED

S1 – 0, S2 – 1, SH – 0 (T-Handle Released)

UNLOCKED

LATCHED Handle OUT

ELECTRONIC CONTROLLED HANDLES

CROSS-REFERENCE TO RELATED APPLICATION

This application is a non-provisional application claiming priority under 35 U.S.C. 119(e) to U.S. Provisional Application Ser. No. 61/636,263 filed on Apr. 20, 2012.

TECHNICAL FIELD OF THE DISCLOSURE

The present disclosure relates to latching and locking handles and, more particularly, relates to electronic control of the locking function of Lift-Handle and T-Handle products.

BACKGROUND OF THE DISCLOSURE

In the vending industry and other industries where product security and secured access are needed, latching and locking handles are commonly used. Two common configurations are the "Lift-Handle" style and the "T-Handle" style. Both the Lift-Handle and T-Handle products comprise a latch mechanism controlled by the handle for manually latching and unlatching an enclosure such as a vending machine or otherwise. Typically these products are mounted to the door of the enclosure, and interface to a slot or receptacle in a cabinet of the enclosure.

The latching mechanism may be any of a variety of mechanisms, such as a threaded bolt that engages into a receptacle, or one or more latch bars or bolts for extending into the cabinet. In the case of the Lift-Handle style latch, movement of the handle from the seated position to an extended or raised position serves to unlatch the door from the cabinet. In the case of the T-Handle style latch, turning of the handle from the vertical seated position to a horizontal position or unscrewing the threaded latch from the receptacle will serve to unlatch the door from the cabinet.

In addition to the latch mechanism, both the Lift-Handle and T-Handle style closures typically comprise a lock-plug for locking and unlocking the handle from movement. Lock plugs are typically controlled by mechanical keys to allow operation of the handle to access the cabinet. However, it is appreciated in the industry that lock plugs are vulnerable to vandalism and theft. As an additional problem related to such plugs, mechanical keys are subject to being lost, copied and stolen.

One solution to the foregoing problems is to replace the above described Lift-Handle and T-Handle products with motorized latch and lock products. Exemplary replacement products are described, for example, in U.S. Pat. No. 6,581,986 entitled "Bayonet Locking System and Method for Vending Machines and the Like." However, there is a further need to provide electronic control of the locking function of Lift-Handle and T-Handle products while maintaining the above-described mechanical latching mechanism function/operation to facilitate retrofit of improved closure systems to existing common cabinets in the industry.

SUMMARY OF THE DISCLOSURE

The present invention will offer electronic control of the locking function of Lift-Handle and T-Handle products, but maintain the above described mechanical latching mechanism function/operation. In accordance with one aspect of the present disclosure, an electronic control lift-handle product is provided having a handle, a housing, a slider bolt, slider bolt pin, slider bolt guide, and one or more springs 4. The product further includes a CAM, motor, circuit board controller, eye, handle sensor, one or more CAM sensors, and an IRDA infrared transceiver. The unit is configured such that the handle seats in the housing when the unit is in the latched or locked position, the motor serves to rotate the CAM by 360 degrees to change the state of handle from locked to unlocked to latched, and the slider bolt seats in the housing and is biased downward to the latched position by the one or more springs, and wherein the CAM maintains the slider bolt in the locked position if there is an attempt to push the slider bolt up to the unlocked position when the unit is locked.

In another embodiment, an electronic control T-handle product is provided having a handle, a housing, latch hardware, a MCU and CPU control electronics. The handle resides inside of the housing, and the MCU is controlled by the CPU to latch, lock and unlock the handle within the housing. The MCU consists of a slider bolt, a spring, a CAM, a motor, a mount, a cover, a handle sensor, and one or more CAM sensors. The handle is locked into the housing by the slider bolt protruding into a handle slot when the unit is latched or locked. The motor serves to rotate the CAM through 360 degrees to change the state of the handle from locked, to unlocked, to latched, and the CAM controls the slider bolt to maintain a locked position if there is an attempt to push the bolt toward the upward unlocked position when the unit is locked.

BRIEF DESCRIPTION OF THE DRAWINGS

FIG. 4A is a front perspective drawing of an aspect of an electronic-control Lift-Handle in accordance with an embodiment of the invention;

FIG. 4B is a back perspective drawing of an aspect of an electronic-control Lift-Handle in accordance with an embodiment of the invention;

FIG. 14 is a perspective drawing of an aspect of an electronic-control T-Handle in accordance with an embodiment of the invention;

FIG. 15 is a plan view drawing of an aspect of an electronic-control T-Handle in accordance with an embodiment of the invention;

Figure 1:
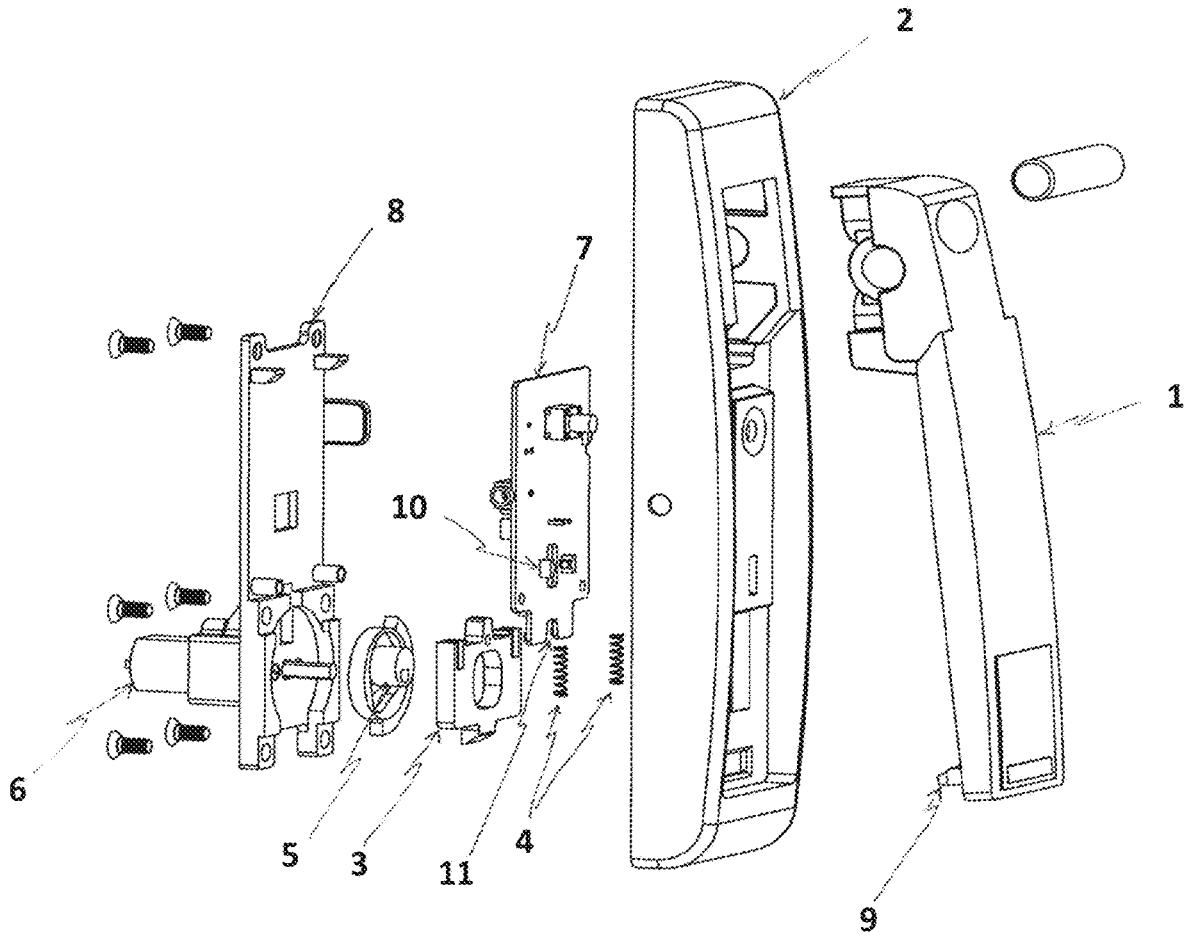
FIG. 1 is a perspective drawing of an aspect of an electronic-control Lift-Handle in accordance with an embodiment of the invention.
Figures 2A, 2B:
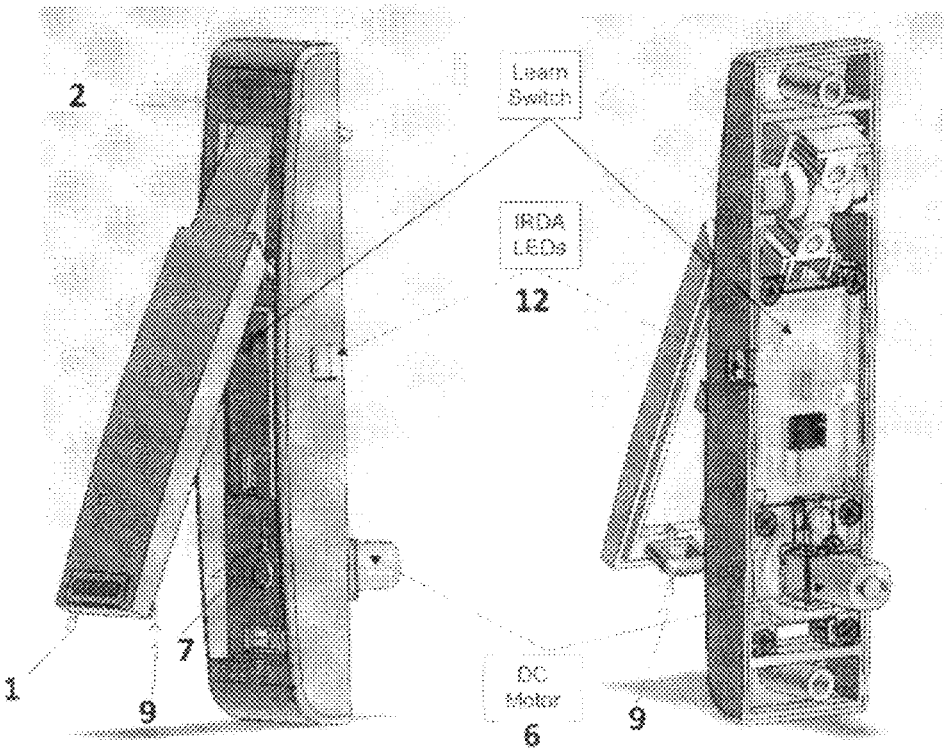
FIG. 2A is a front perspective drawing of an aspect of an electronic-control Lift-Handle in accordance with an embodiment of the invention.
FIG. 2B is a back perspective drawing of an aspect of an electronic-control Lift-Handle in accordance with an embodiment of the invention.
Figure 3:
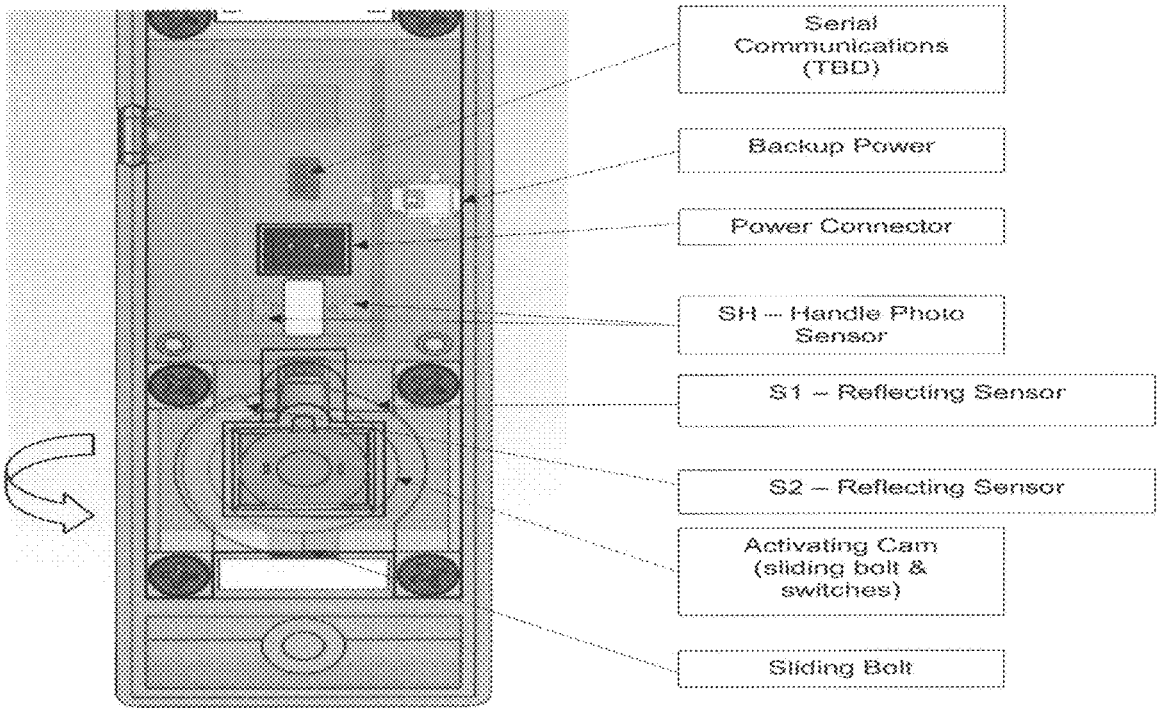
FIG. 3 is a plan view of an aspect of an electronic-control Lift-Handle in accordance with an embodiment of the invention.

While the present disclosure is susceptible to various modifications and alternative constructions, certain illustrative embodiments thereof will be shown and described below in detail. It should be understood, however, that there is no intention to be limited to the specific embodiments disclosed, but on the contrary, the intention is to cover all modifications, alternative constructions, and equivalents that fall within the spirit and scope of the present disclosure.

DETAILED DESCRIPTION OF THE DISCLOSURE

While this disclosure describes certain lock structures, it should be appreciated that the electronic lock components described herein are not specific to the Lift-Handle and T-Handle products, but rather can be implemented directly, or modified, to control almost any handle-controlled latch/lock mechanism in the industry. This disclosure will first discuss an exemplary embodiment of a lift handle system, and then will move on to discuss an exemplary embodiment of a T-handle system.

Regarding the Electronic Control Lift-Handle, this product is configured for mounting to the door of a cabinet, and attaches to latch hardware to latch the door to the cabinet. The product consists of a handle 1, housing 2, slider bolt 3, springs 4, CAM 5, motor 6, circuit board controller 7, cover 8, eye 9, handle sensor 10, CAM sensors 11, IRDA infrared transceiver 12, Slider bolt pin 13, Slider bolt guide 70, Housing slot 71.

The handle 1 seats in the housing 2 when the unit is in the latched or locked position. The eye 9 attaches to the handle 1, and is held in place by the slider bolt 3 when the unit is latched or locked. The motor 6 serves to rotate CAM 5 by 360 degrees to change the state of handle 1 from locked to unlocked to latched.

The slider bolt 3 seats in the housing 2 and is biased downward to the latched position (See FIG. 7) by springs 4. The slider bolt guide 70 fits into housing slot 71. The guide 70 is centered on slider bolt 3, and is configured to slide up and down in slot 71 to keep the slider bolt 3 aligned in the housing 2, e.g., to keep it from tilting and from jamming as the slider bolt 3 slides or moves.

Figure 5:
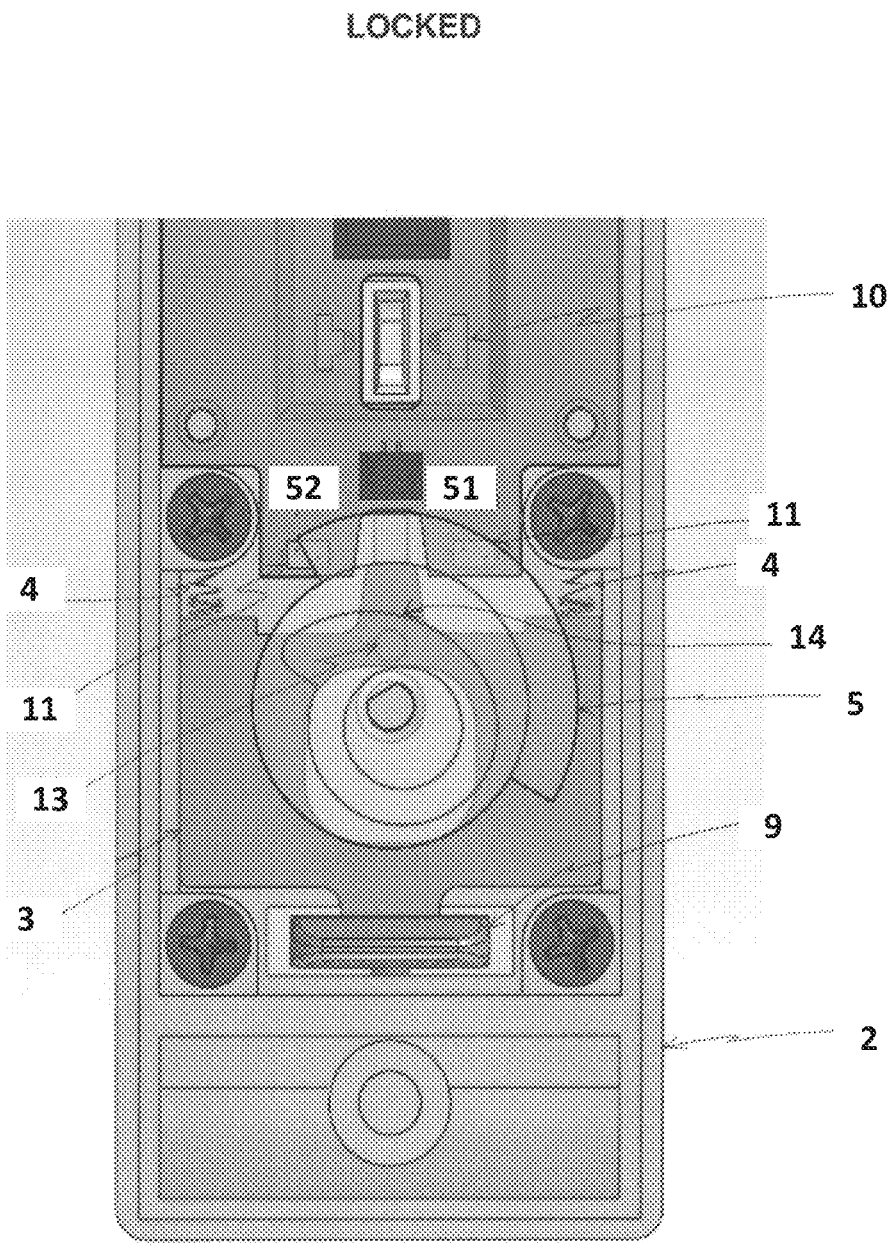
FIG. 5 is a plan view drawing of an aspect of an electronic-control Lift-Handle in accordance with an embodiment of the invention.
Figure 6:
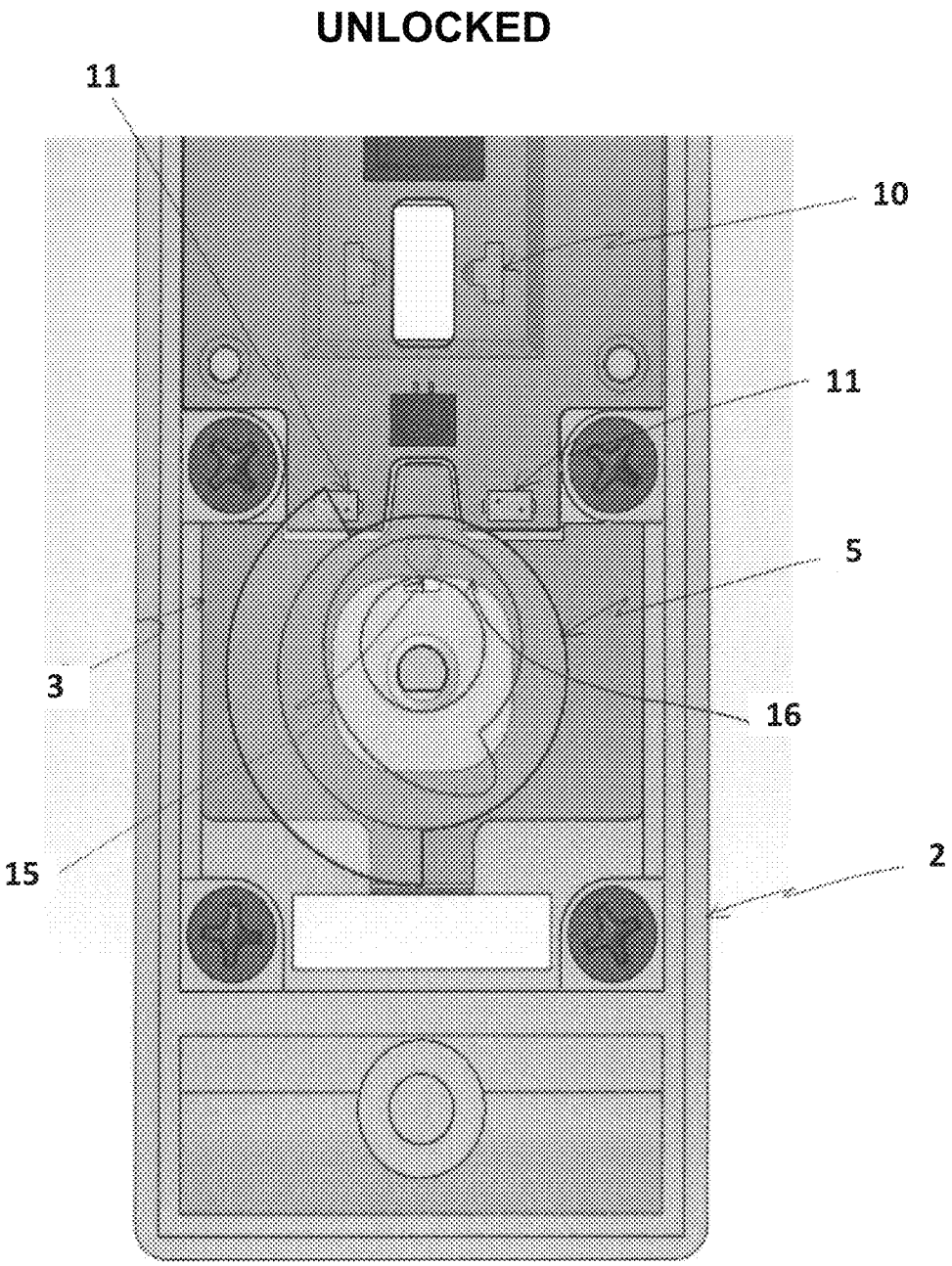
FIG. 6 is a plan view drawing of an aspect of an electronic-control Lift-Handle in accordance with an embodiment of the invention.

The CAM 5 controls the slider bolt 3 by being capable of keeping the slider bolt 3 in the locked position by surface 14 interfering with slider bolt pin 13 if there is an attempt to push the slider bolt 3 up to the unlocked position when the unit is locked (see FIG. 5). The CAM 5 controls the slider bolt 3 by applying a force from surface 15 to the slider bolt along surface 16 when the motor 6 is rotated and when the unit is unlocked (see FIG. 6).

The electronic controller 7 controls the motor 6 to rotate the CAM 5 to the three positions noted above. The position of the CAM 5 is controlled and sensed by two optical sensors 11 sensing the position of CAM 5 in the illustrated example. A handle position sensor 10 is also utilized in an embodiment. An IRDA infrared transceiver 12 is included for detecting an electronic key. The control of the unit is described in the flow charts of FIGS. 9, 10, and 11.

Figure 9:
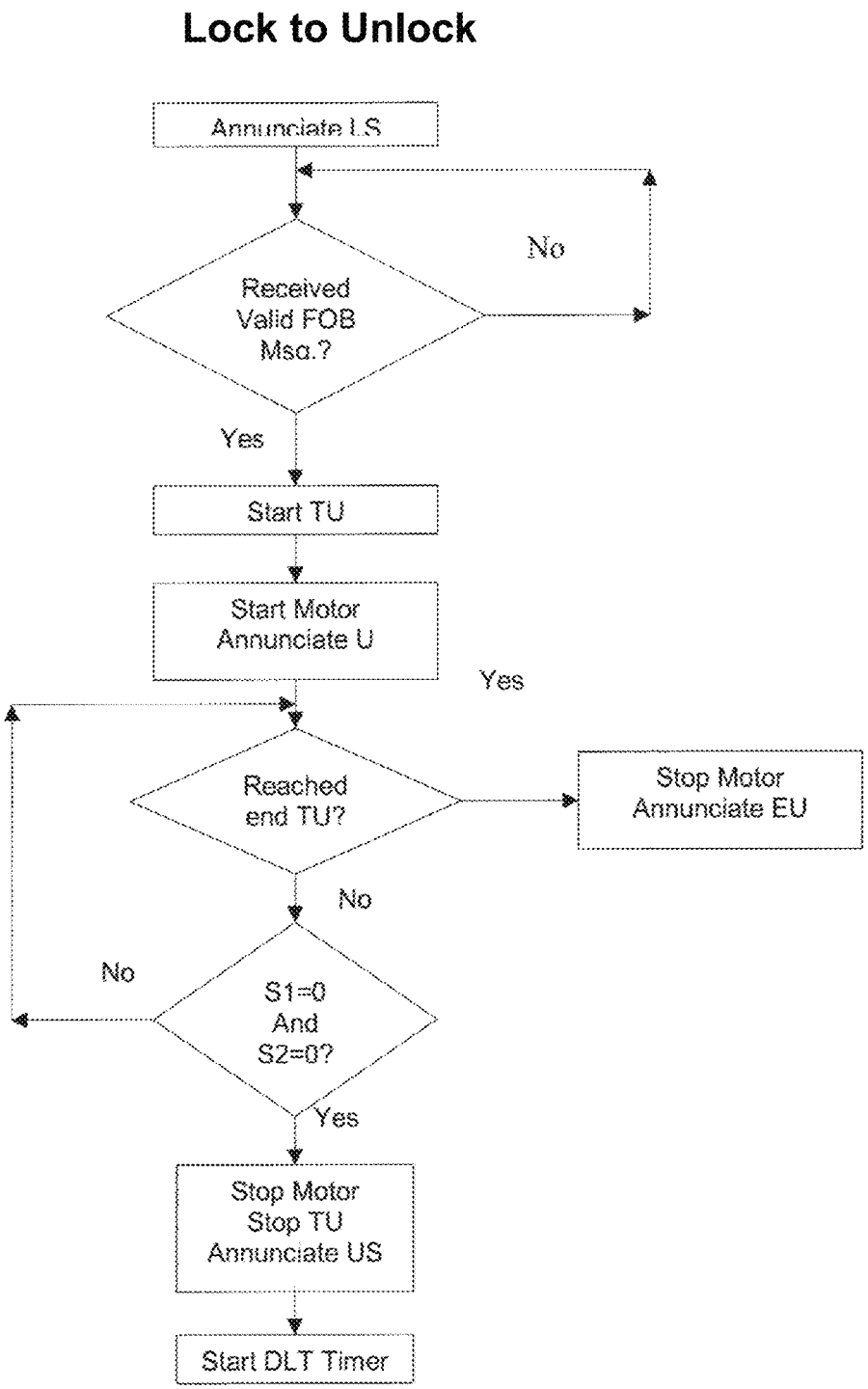
FIG. 9 is a flow chart of an aspect of an electronic-control Lift-Handle in accordance with an embodiment of the invention.

In the flow chart of FIG. 9, the unit is initially locked as in the configuration shown in FIG. 5. If the controller IRDA infrared transceiver 12 detects the electronic key, cam 5 is rotated and applies an upward force to sliding bolt 3 along surface 16 to move the slider bolt 3 against the downward spring bias force and lift bolt 3 to the unlocked position reflected in FIG. 6. Sensors 11 measure position of CAM 5 and provide a signal to the controller for determining proper control of the motor. Once in the unlocked position, the eye 9 attached to the handle 1 is released from interference by slider bolt 3 and handle 1 is capable of being lifted from housing 2 and optionally rotated.

Figure 7:
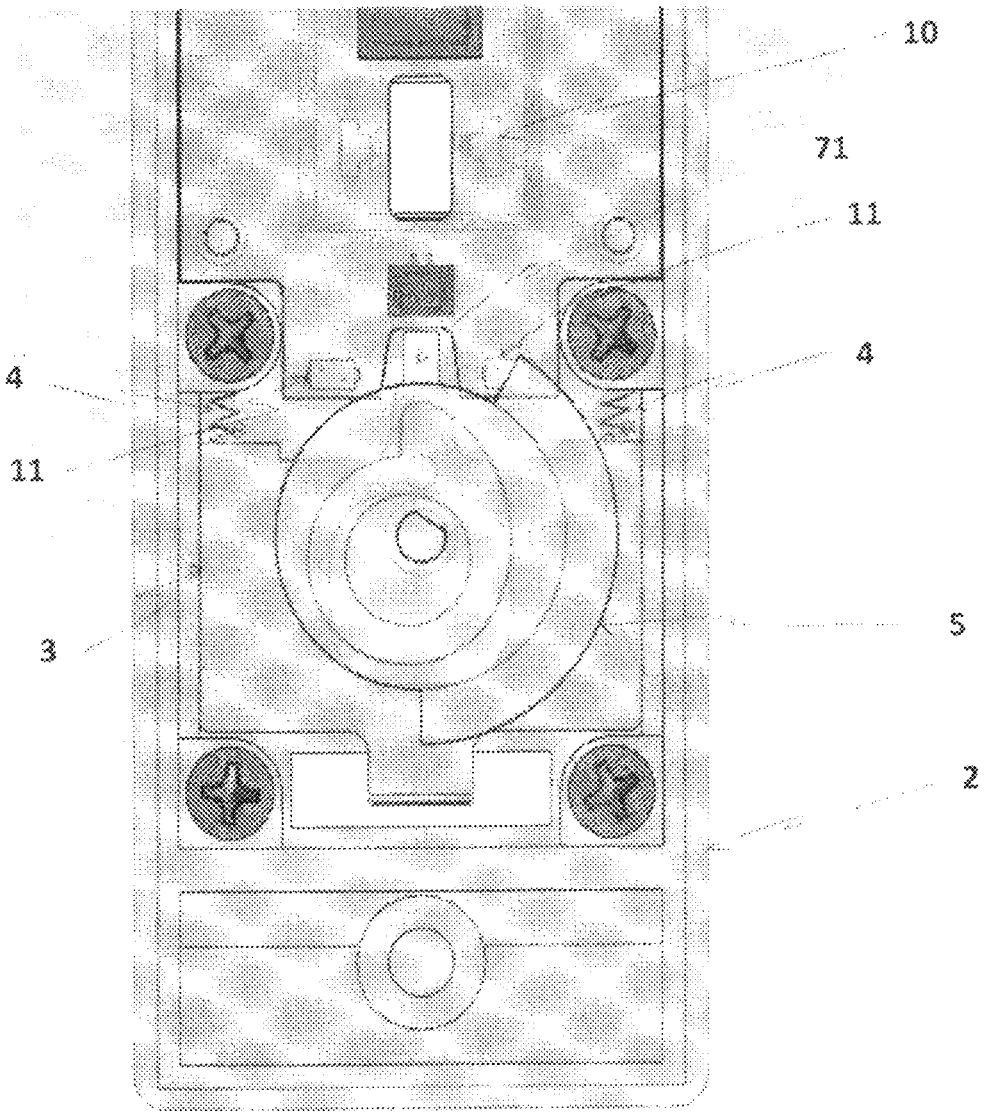
FIG. 7 is a plan view drawing of an aspect of an electronic-control Lift-Handle in accordance with an embodiment of the invention.
Figure 10:
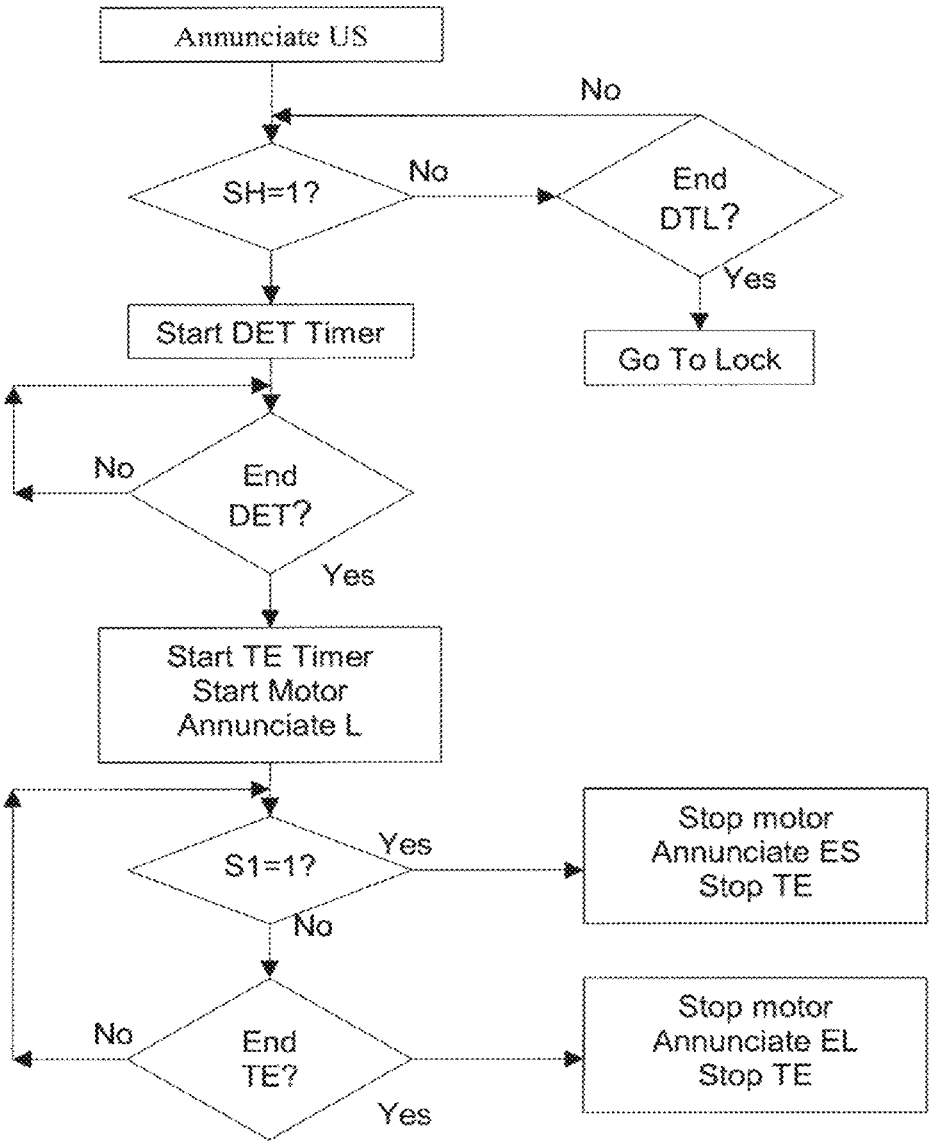
FIG. 10 is a flow chart of an aspect of an electronic-control Lift-Handle in accordance with an embodiment of the invention.

As shown in the flow chart of FIG. 10, the controller 7 senses the position of the handle 1, and after the handle 1 is unlocked and the user proceeds to lift (and optionally rotate) the handle 1 to unlatch the door from the cabinet, the controller 7 proceeds to energize the motor 6 to move the CAM 5 to the latched position shown in FIG. 7. In the latched position, the slider bolt 3 is biased to the position shown in FIG. 7 by one or more springs 4.

Figure 8:
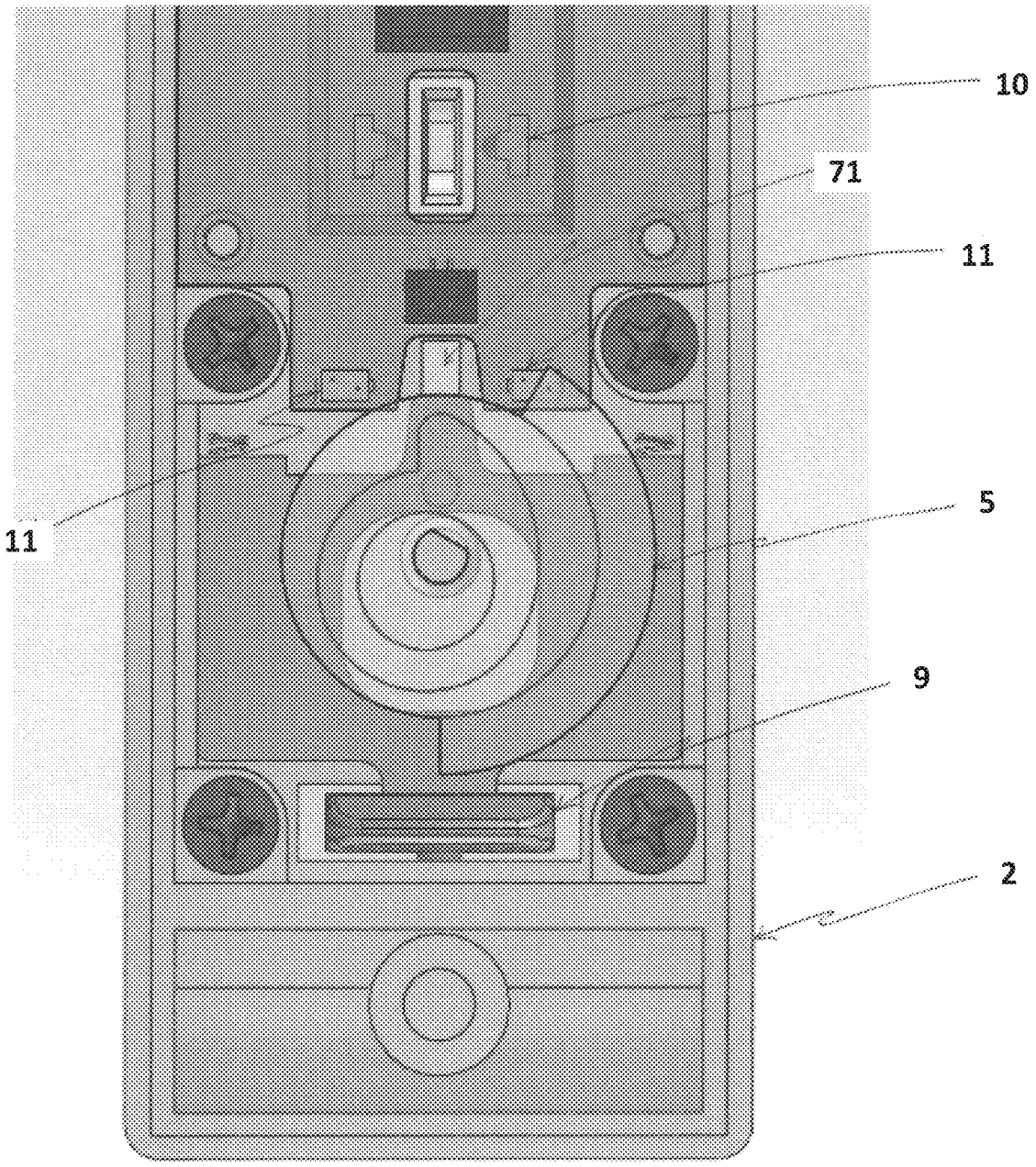
FIG. 8 is a plan view of an aspect of an electronic-control Lift-Handle in accordance with an embodiment of the invention.
Figure 11:
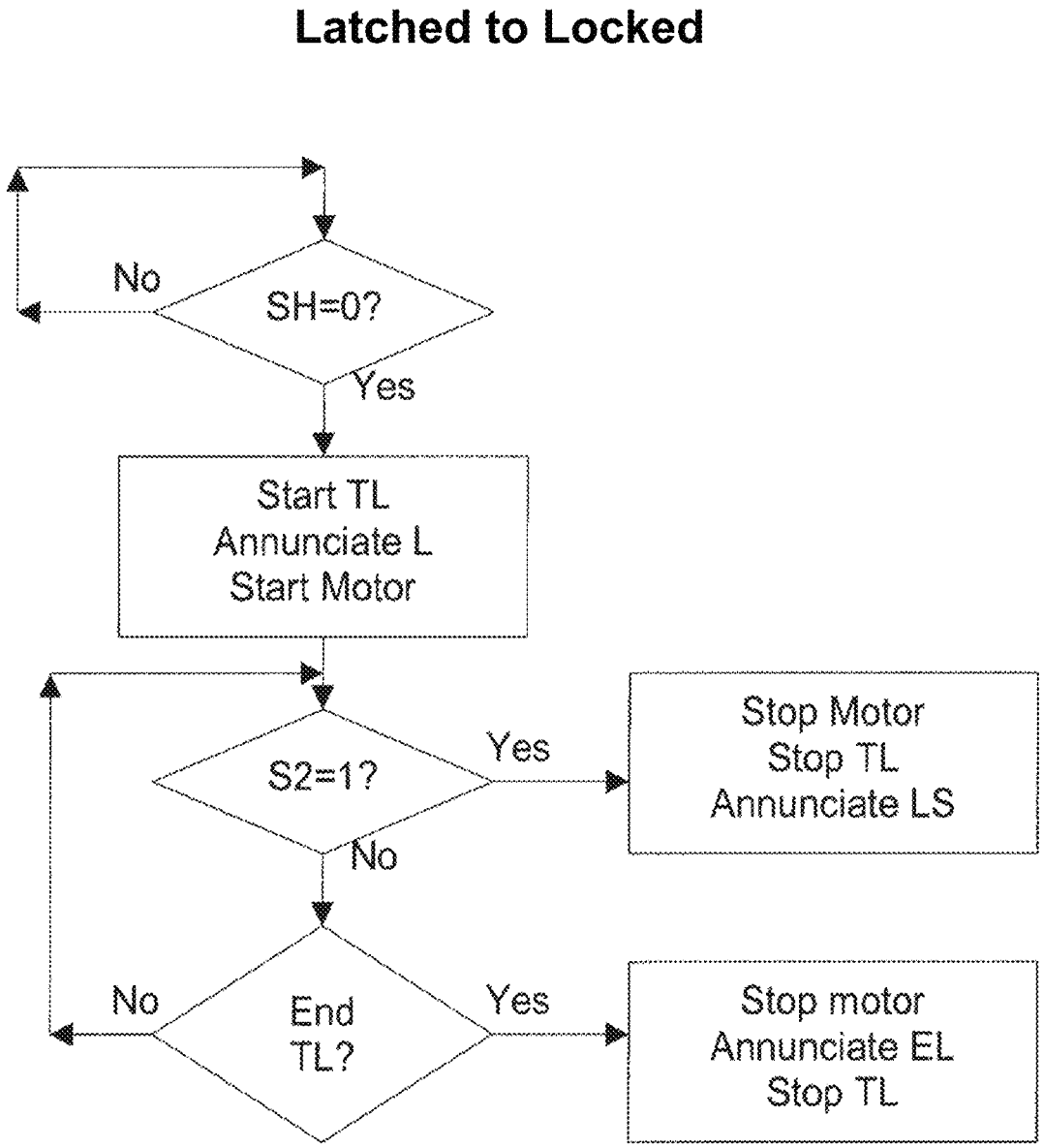
FIG. 11 is a flow chart of an aspect of an electronic-control T-Handle in accordance with an embodiment of the invention.
Figure 12:
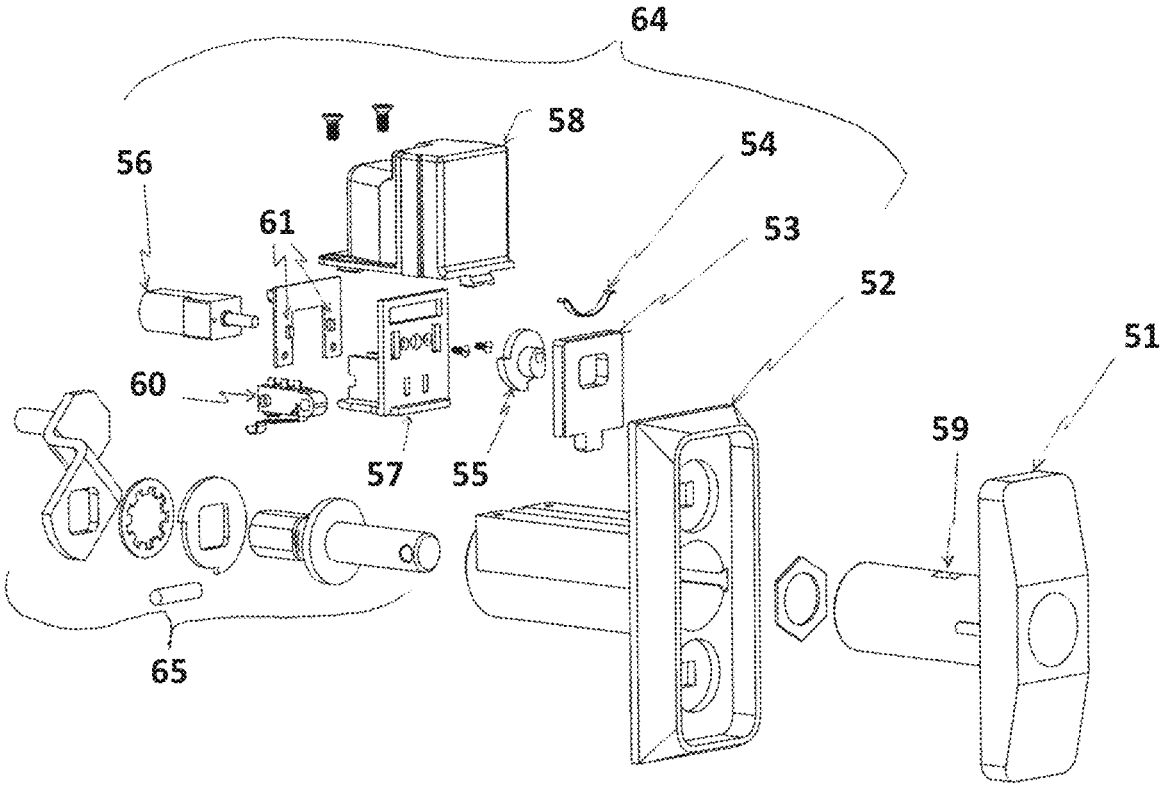
FIG. 12 is a perspective drawing of an aspect of an electronic-control T-Handle in accordance with an embodiment of the invention.

As described in the flowchart of FIG. 11, when the user is finished accessing the cabinet, the handle 1 is pushed into the housing 2, and the eye 9 pushes against the slider bolt 3 such that the slider bolt 3 is forced by the eye 9 upward against the bias of the springs 4 so as to lift up and allow the eye 9 to pass by the slider bolt 3. Once the eye 9 passes the slider bolt 3, the springs 4 push the slider bolt 3 back to the latched position, capturing the eye 9. The controller 7 senses the handle 1 in the housing 2 via sensor 10, then first waits for the eye 9 to pass under the slider bolt 3 as shown in FIG. 8 before proceeding to rotate the CAM 5 to the locked position shown in FIG. 5.

Referring still to FIG. 5, if an attempt is made to manually lift the slider bolt 3 upward, the CAM 5 interferes at surface 14 with slide bolt pin 13 to maintain the slider bolt 3 in the locked position. With the CAM 5 interfering with the slider bolt pin 13, the unit is less vulnerable to a thief or vandal attempting to defeat the lock by using either a tool or a vibration force to move the slider bolt 3 upward against the weaker downward force of springs 4.

As can be seen from the above, the disclosed electronic control lift-handle product is an effective solution that is able to be mounted to the door of a cabinet, and to secure the door in a manner that overcomes some of the problems found in prior systems. In addition to the electronic control lift-handle product, the novel electronic control t-handle product, while differently configured, is substantially as effective at providing a secure closure in a manner that overcomes problems in prior designs.

The electronic control t-handle product consists of a handle 51, a housing 52, latch hardware 65, a MCU 64 and CPU control electronics (not shown). The housing 52 is mounted to the door of a cabinet, and the latch hardware 65 is attached to a latch device that will operate to latch and unlatch the door to the cabinet. The MCU 64 attaches to the body of the housing 52, and the handle 51 resides inside of the housing 51. The MCU 64 is controlled by the CPU to latch, lock and unlock the handle 51 within the housing 52. When the MCU 64 unlocks the handle 51, the handle pops-out of the housing 52 for the user to operate. The user operates the handle 51 by turning it ¼ turn (90 degrees) clock-wise to operate latch hardware 65. When finished, the user closes the cabinet door, turns the handle 51 ¼ turn in the counter-clockwise direction to re-latch the door to the cabinet. Lastly, the user pushes the handle 51 in so as to lock the handle 51 into the housing 52.

In the illustrated embodiment, the MCU 64 consists of a slider bolt 53, a spring 54, a CAM 55, a motor 56, a mount 57, a cover 58, a handle sensor 60, and one or more CAM sensors 61. The handle 51 seats in the housing 52 when the unit is in the latched or locked position, and is locked into the housing 52 by the slider bolt 53 protruding into handle slot 59 when the unit is latched or locked.

Figure 16A:
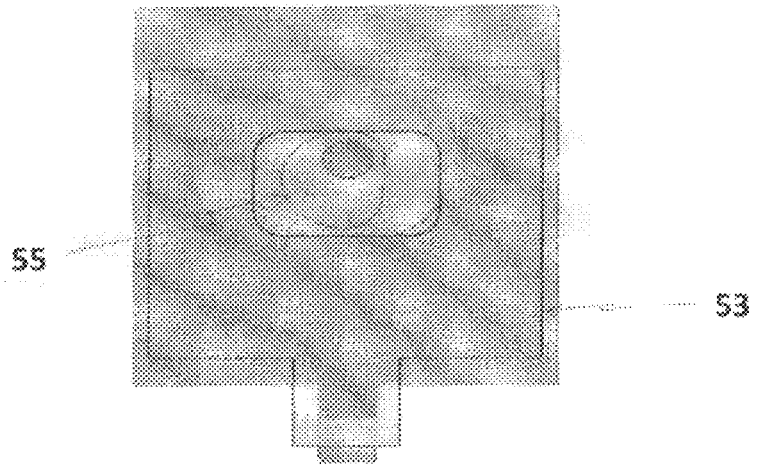
FIGS. 16*a*, 16*b* and 16*c* are plan view drawings of an aspect of an electronic-control T-Handle in accordance with an embodiment of the invention.
Figure 16B:
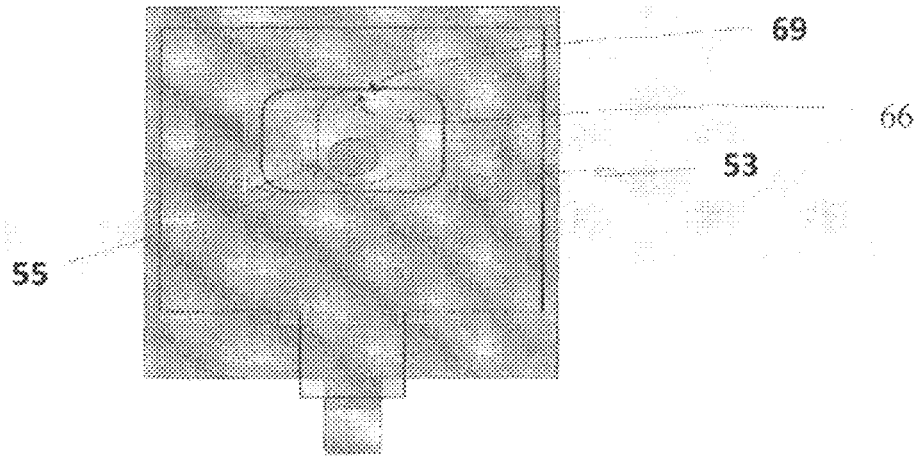

The motor 56 serves to rotate the CAM 55 through 360 degrees to change the state of the handle 51 from locked, to unlocked, to latched. The slider bolt 53 is biased to be latched in the downward position into slot 59 by spring 54 as shown in FIG. 14. The CAM 5 controls the slider bolt 53 by applying a force from surface 66 to the slider bolt 53 surface 67 if there is an attempt to push the bolt toward the upward unlocked position when the unit is locked as shown in FIGS. 15 and 16A. The CAM 5 further controls the slider bolt 53 by applying a force from surface 66 to the slider bolt along surface 69 when the motor 56 is rotated and when the unit is unlocked as shown in FIG. 16B.

The electronic controller CPU controls motor 56 to rotate CAM 55 to three positions. The position to which CAM 55 is controlled or rotated is sensed by two optical sensors 61 sensing the position of CAM 55. A handle position sensor 60 is also utilized. An IRDA infrared transceiver (not shown) is included for detecting an electronic key. The control of the unit is described in the flow charts of FIGS. 17, 18, and 19.

Figure 17:
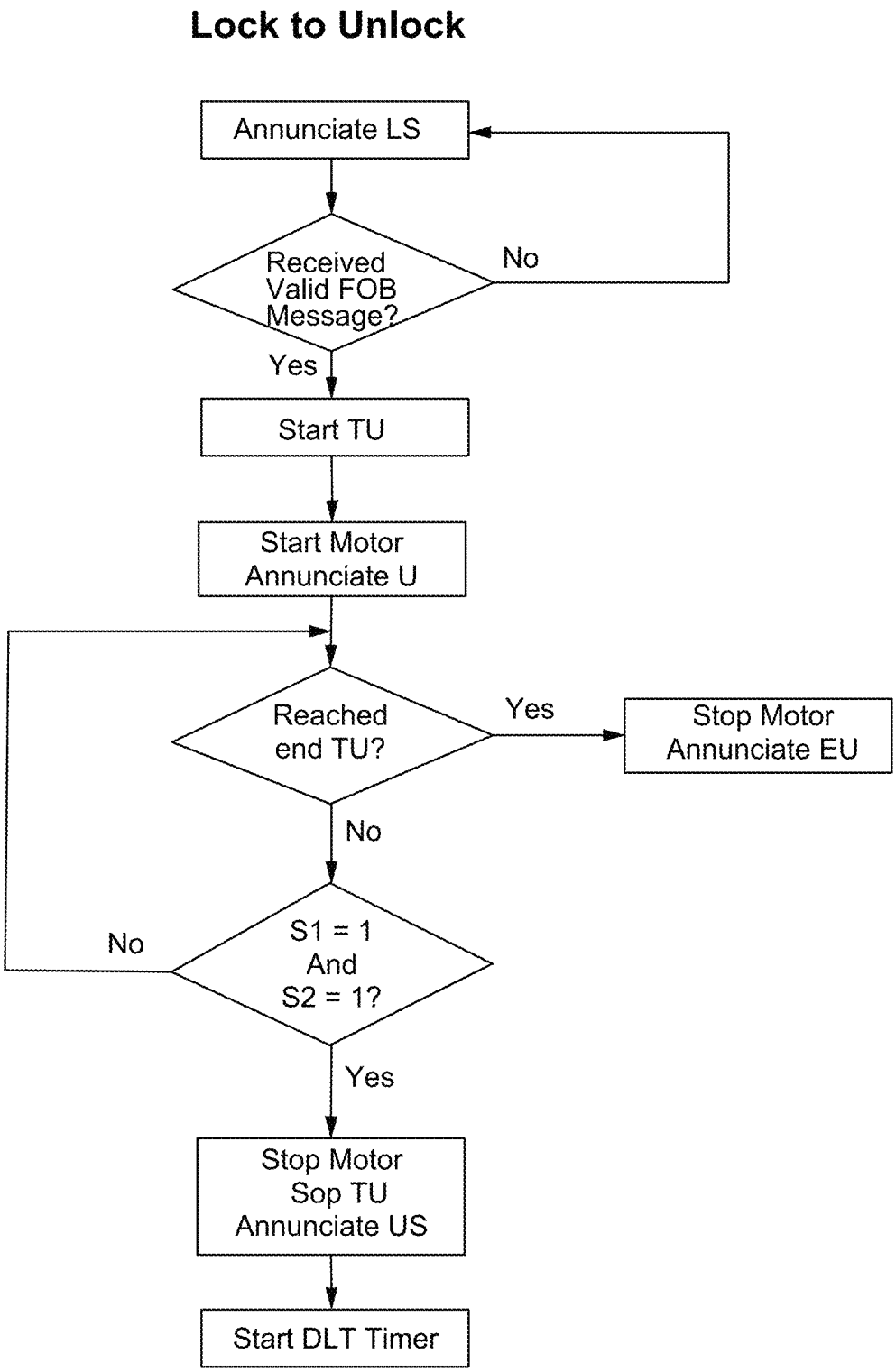
FIG. 17 is a flow chart of an aspect of an electronic-control T-Handle in accordance with an embodiment of the invention.

In the flow chart of FIG. 17, the unit is initially locked as shown in FIGS. 15 and 16A. If the controller IRDA infrared transceiver detects the electronic key, the cam 55 is rotated and applies an upward force to the sliding bolt 53 along surface 69 to move the slider bolt 53 against the downward spring bias force and lift bolt 53 to the unlocked position as shown in FIG. 16B. The sensors 61 measure the position of the CAM 55 and provide a signal to the controller for determining proper control of the motor. Once the slider bolt 53 is in the unlocked position, the handle 51 is released from interference by the slider bolt 53 and is released from the housing 52 and rotated by the user.

Figure 16C:
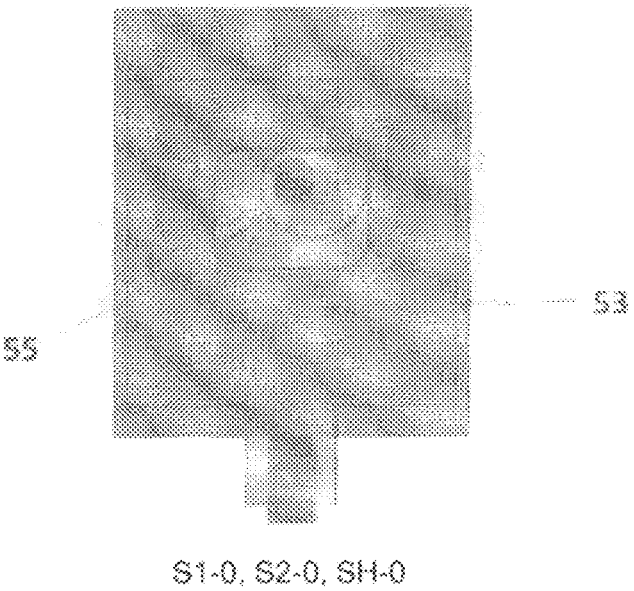
Figure 18:
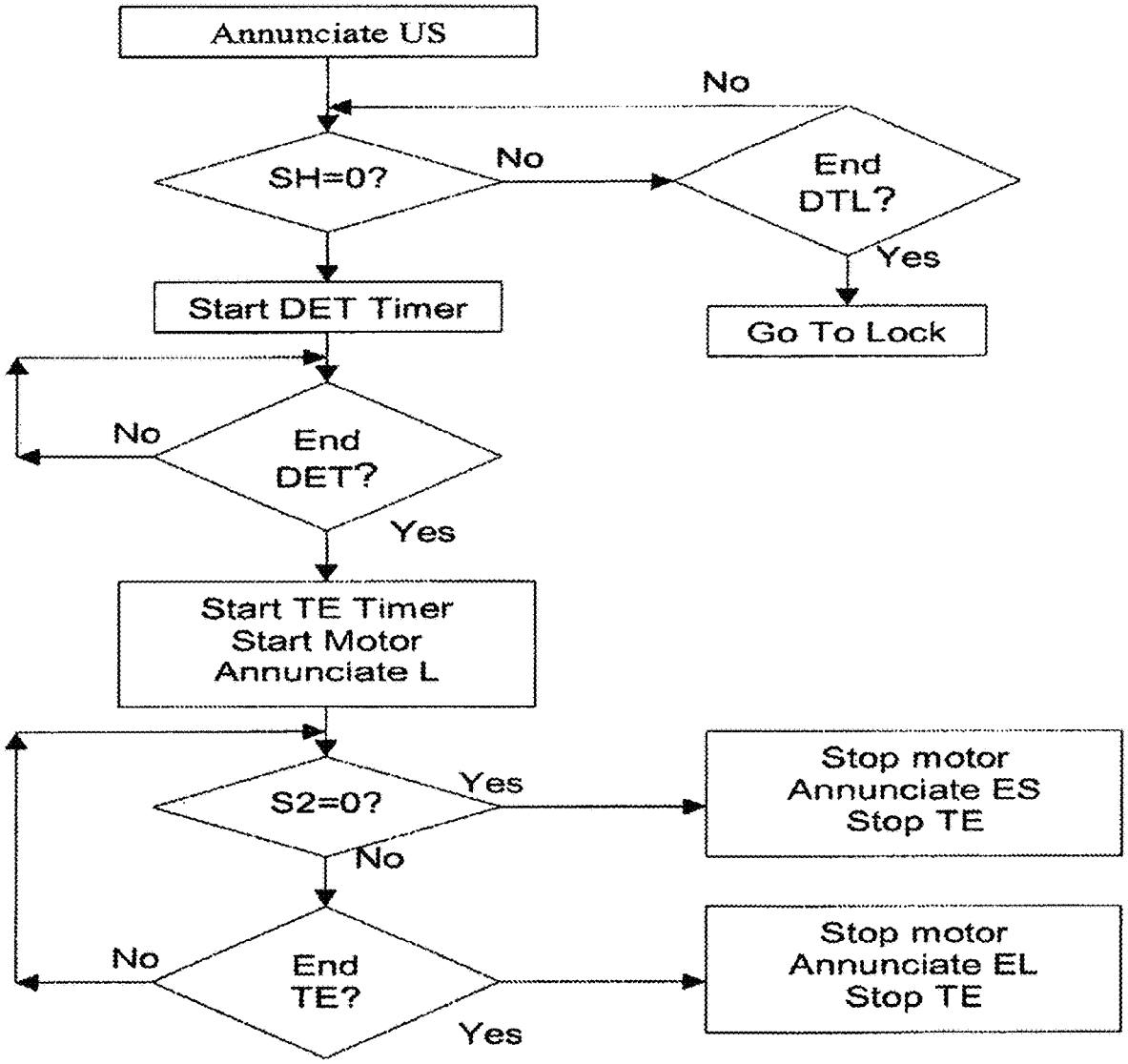
FIG. 18 is a flow chart of an aspect of an electronic-control T-Handle in accordance with an embodiment of the invention.

In the flow chart of FIG. 18, the position sensor 60 and the CPU controller sense the position of the handle 51, and after the handle 51 is unlocked and the user proceeds to rotate the handle 51 to unlatch the door from the cabinet, the controller proceeds to energize the motor 56 to move the CAM 55 to the latched position in FIG. 16C. In the latched position, the slider bolt 3 is biased by the spring 54 to the position shown in FIG. 16C.

Figure 19:
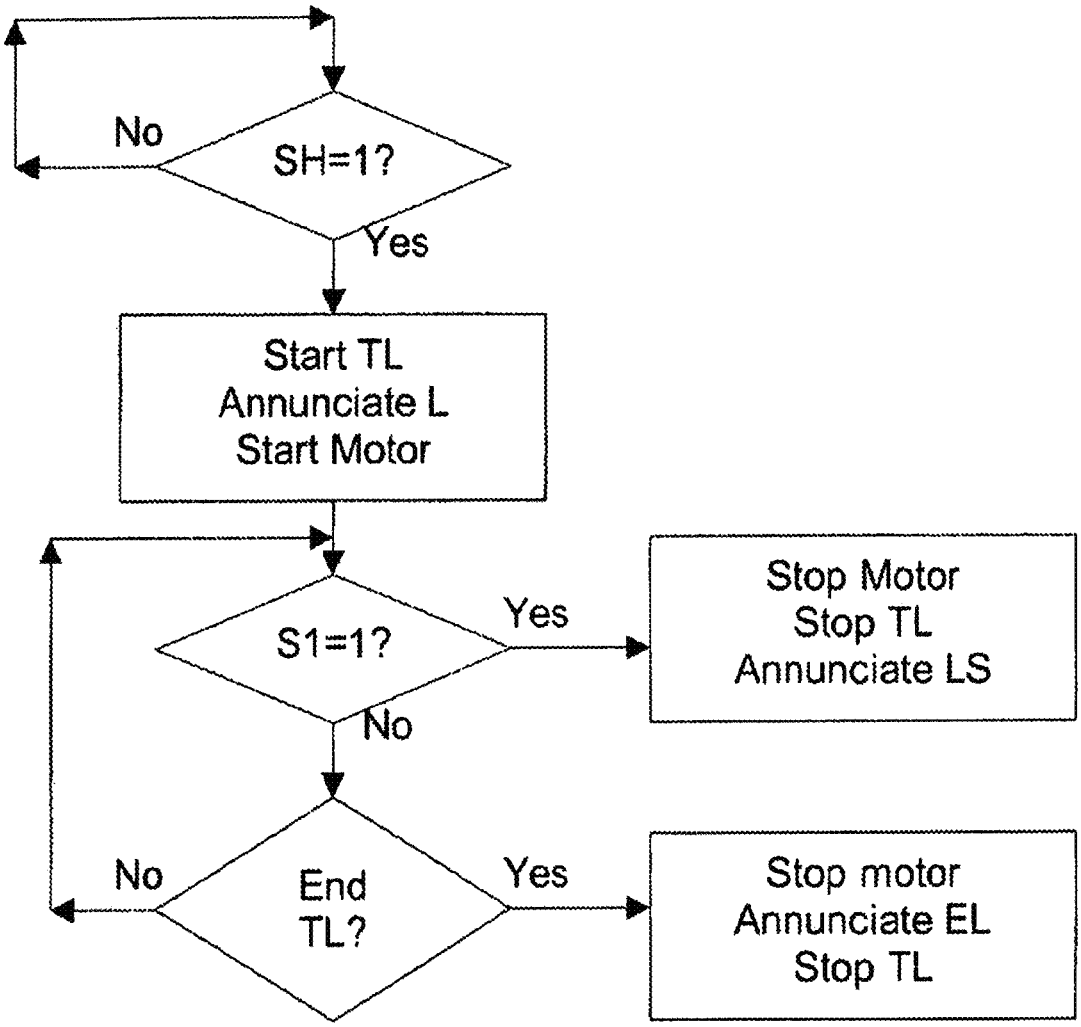
FIG. 19 is a flow chart of an aspect of an electronic-control T-Handle in accordance with an embodiment of the invention.

As described in the flowchart of FIG. 19, when the user is finished accessing the cabinet, the handle 51 is pushed into housing 52 when causing a surface of the handle 51 to push against the slider bolt 53, such that the slider bolt 53 is forced upward against the bias of spring 54 so as to lift upward to allow the handle 51 to protrude into the housing 52. Once the handle slot 59 passes the slider bolt 53, the spring 4 will push the slider bolt 53 back to the latched position to hold the handle 51 into the housing 52. The controller, sensing via sensor 60 that the handle 51 is in the housing 52, will first wait for slot 59 to pass under the slider bolt 53 and will then rotate the CAM 55 to the locked position as shown in FIG. 16A.

In the configuration illustrated in FIGS. 15 and 16A, the CAM 55 will apply a force at surface 66 to the slider bolt 53 at surface 67 to maintain the slider bolt 53 in the locked position in the event that an attempt is made to manually lift the slider bolt 53 upward. Through the ability of the CAM 55 to hold the slider bolt 53 in the locked position, the unit is less vulnerable to a thief or vandal attempting to defeat the lock using a tool or a vibration force to move slider bolt 53 upward against the weaker downward force of spring 54.

Figure 20:
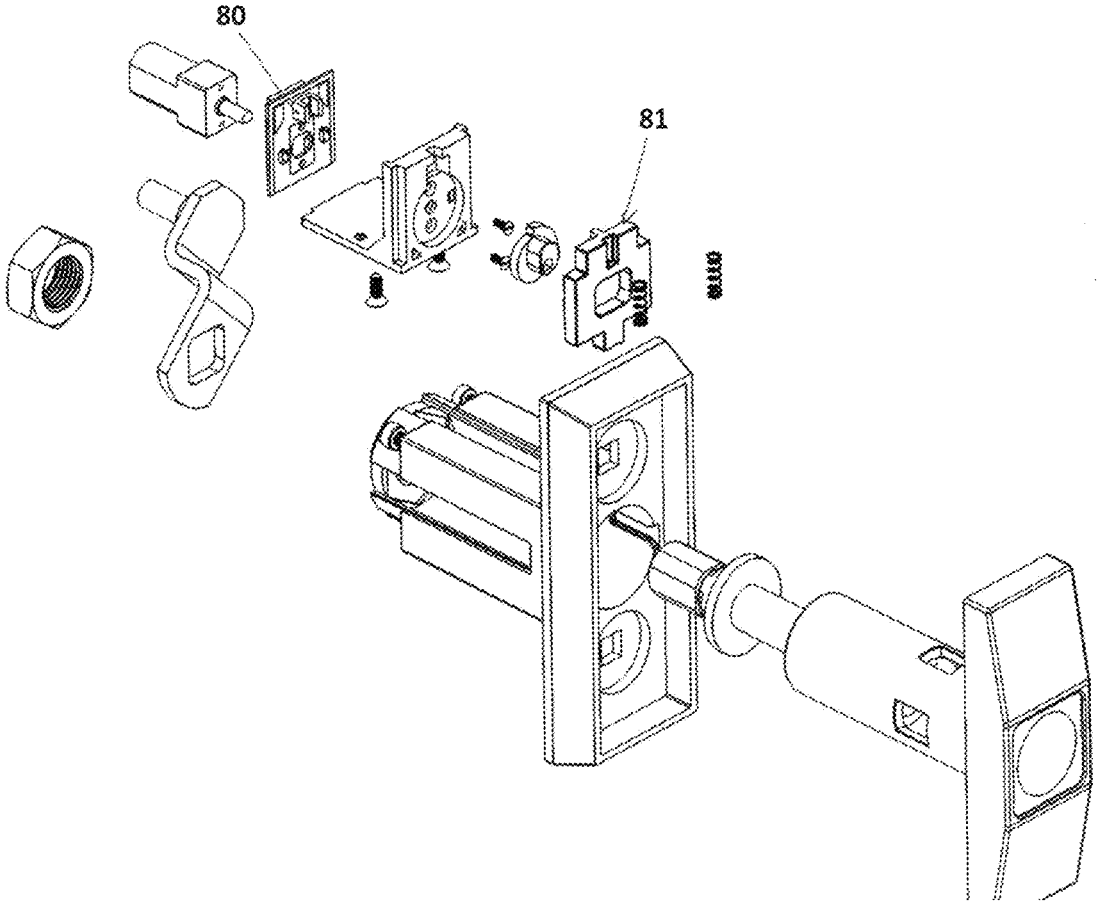
FIG. 20 is a perspective drawing of an aspect of an electronic-control T-Handle in accordance with an embodiment of the invention.

FIG. 20 is drawing of an alternate embodiment of the MCU with a sensor 80 for detecting the slider bolt 81. By detecting the slider bolt, the controller can identify the position of the handle, whether it is unlocked and extended with the slider in the retracted position or locked and in the extended position. This sensor can be used in conjunction with or in place of handle detector switch 60.

Figure 13:
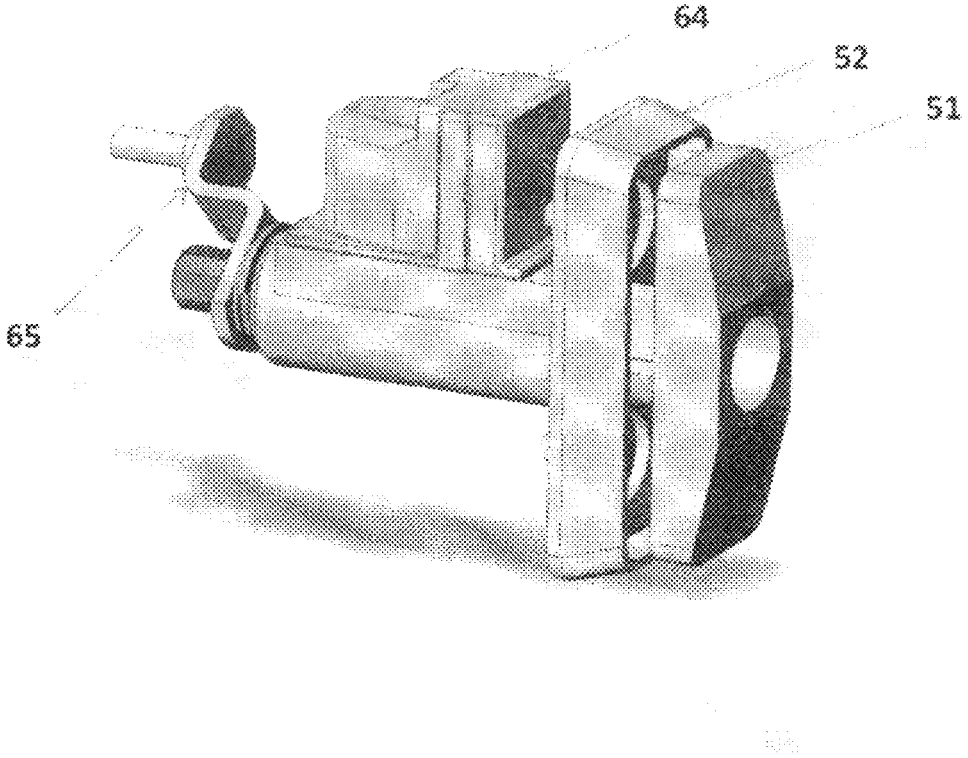
FIG. 13 is a perspective drawing of an aspect of an electronic-control T-Handle in accordance with an embodiment of the invention.
Figure 21:
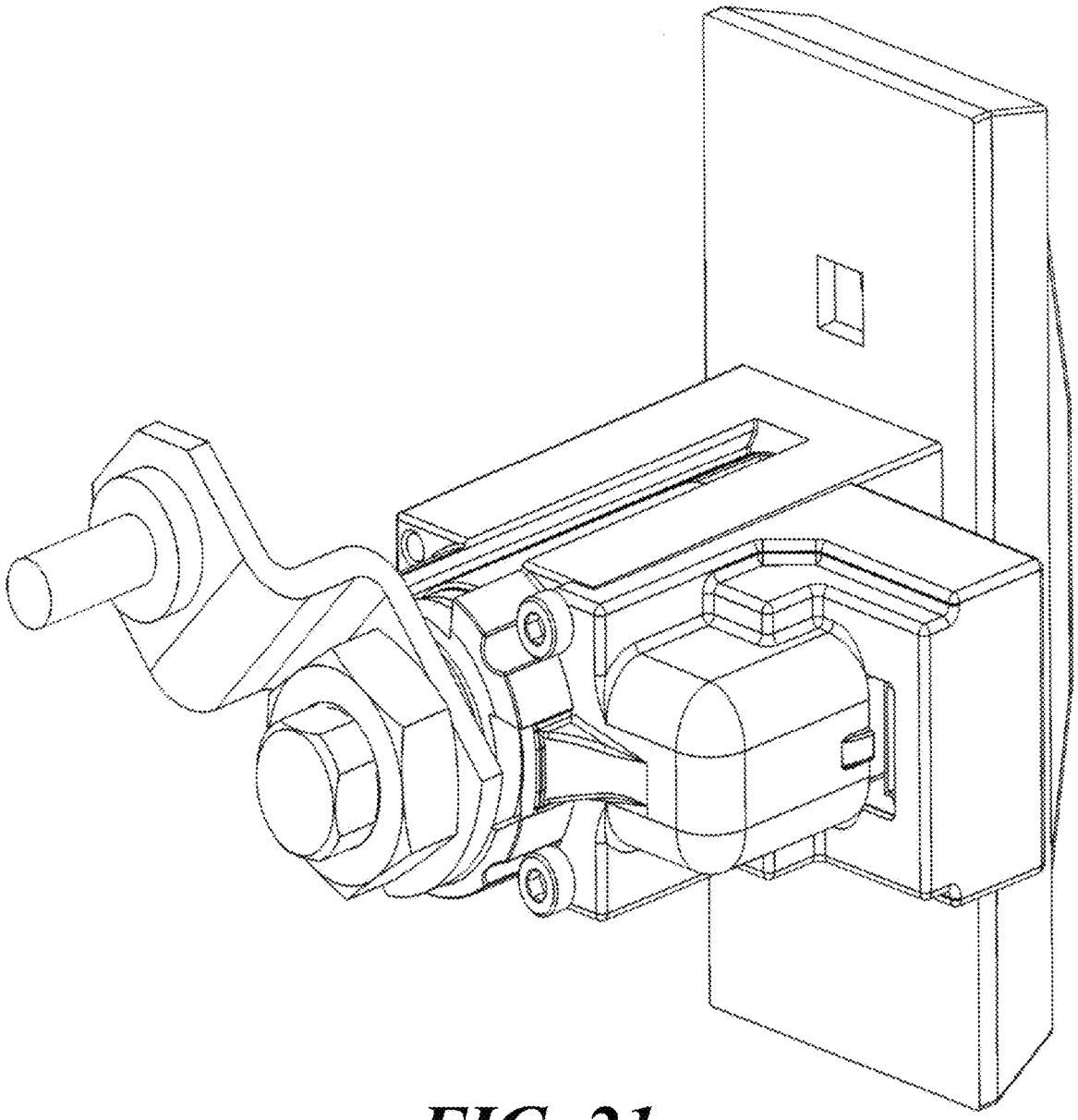
FIG. 21 is a perspective drawing of an aspect of an electronic-control T-Handle in accordance with an embodiment of the invention.
Figure 22:
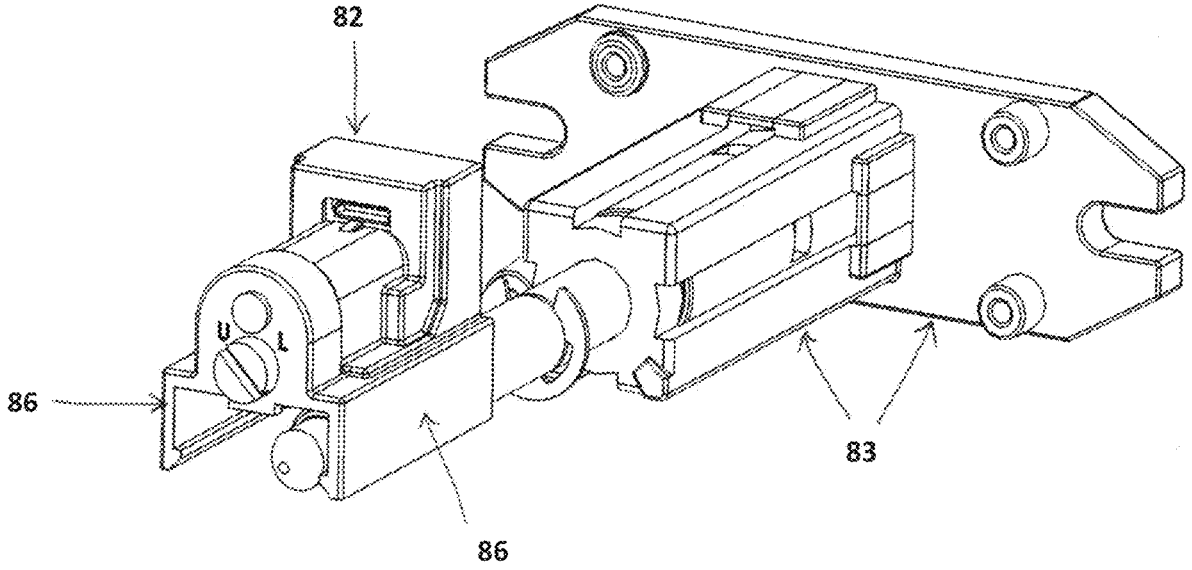
FIG. 22 is a perspective drawing of an aspect of an electronic-control T-Handle in accordance with an embodiment of the invention.

Similarly, the drawing of FIG. 21 shows an alternate optional mounting position of the MCU on the t-handle housing at the 3:00 position. Alternate mounting positions will be useful in retrofit applications whereby a vending machine may have other accessories mounted around the T-handle, and the installer requires the flexibility of mounting the MCU at either the 12:00 (as in FIG. 13), 3:00 (FIG. 21), 6:00 or 9:00 positions, i.e., whichever position is unobstructed and allows the position of the MCU to not interfere with pre-existing accessory equipment in the machine.

FIGS. 22-26 show an alternative design 82 of the MCU, whereby the MCU will mount to housing 83 which was pre-installed in vending machines. The pre-installed housing would normally house a standard t-handle and a lock plug/core operated by a mechanical key. In order to retrofit the invention to a vending machine and to avoid the labor and material to replace the existing housing, the pre-installed housing will remain in the machine. MCU 82 is similar to MCU 64 except for the way it slides onto and fastens to pre-existing housing 83.

Figure 23:
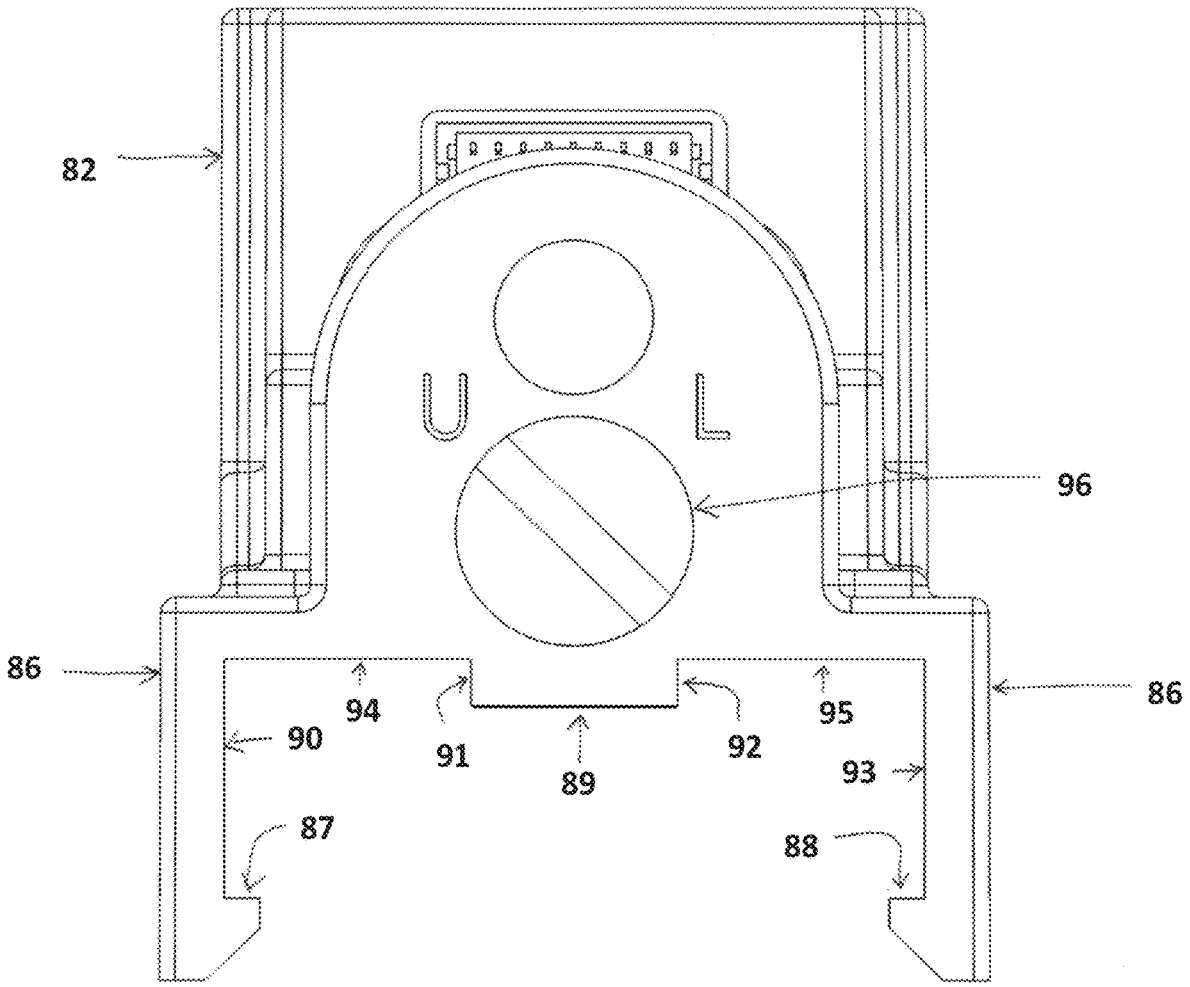
FIG. 23 is a plan view drawing of an aspect of an electronic-control T-Handle in accordance with an embodiment of the invention.

MCU 82 has legs 86 that will extend along the vertical surfaces of housing 83, and the rear view of MCU 82 in FIG. 23 shows the MCU surfaces that could potentially touch housing 83 during installation, such as horizontal edges 87, 88, 89, 94, 95 and vertical surfaces 90, 91, 92, and 93 that will capture housing 83 at least partially along multiple outer surfaces of housing 83. Fastener 96 is used to fasten the MCU to the housing once seated.

Figure 24:
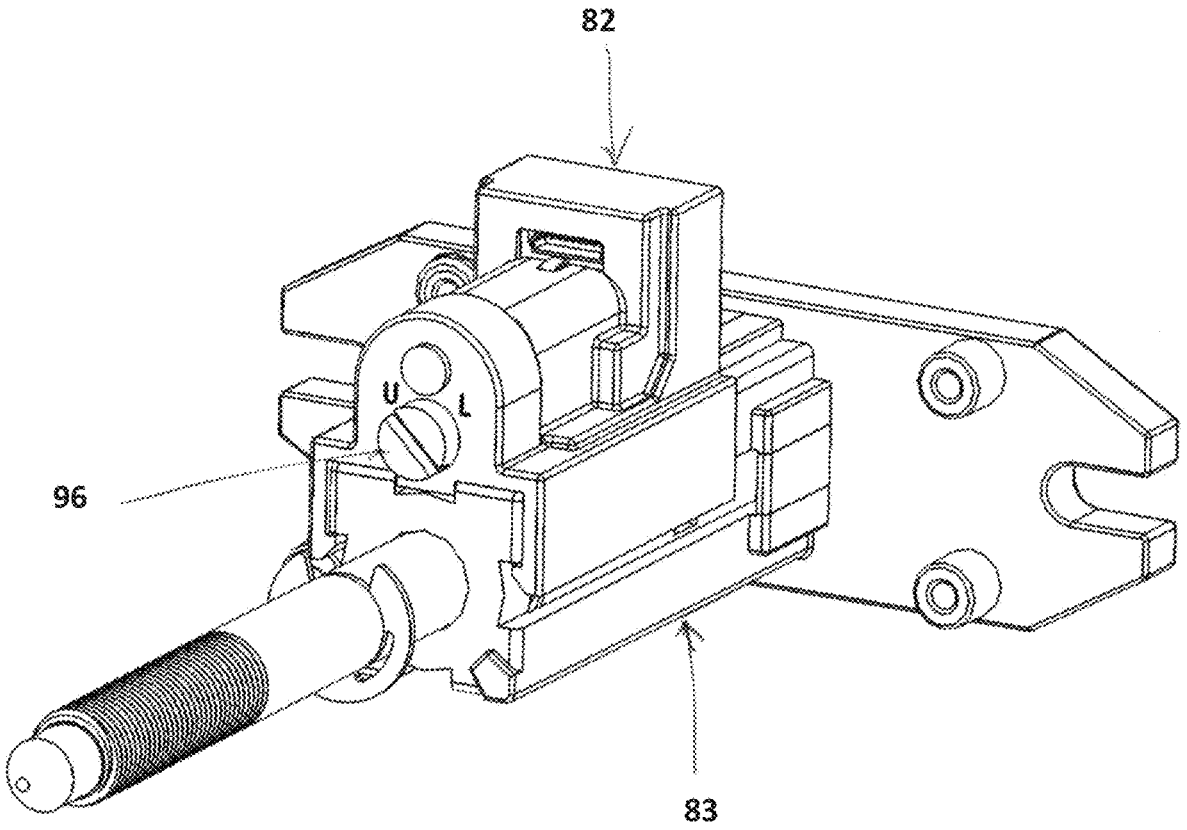
FIG. 24 is a perspective drawing of an aspect of an electronic-control T-Handle in accordance with an embodiment of the invention.
Figure 25:
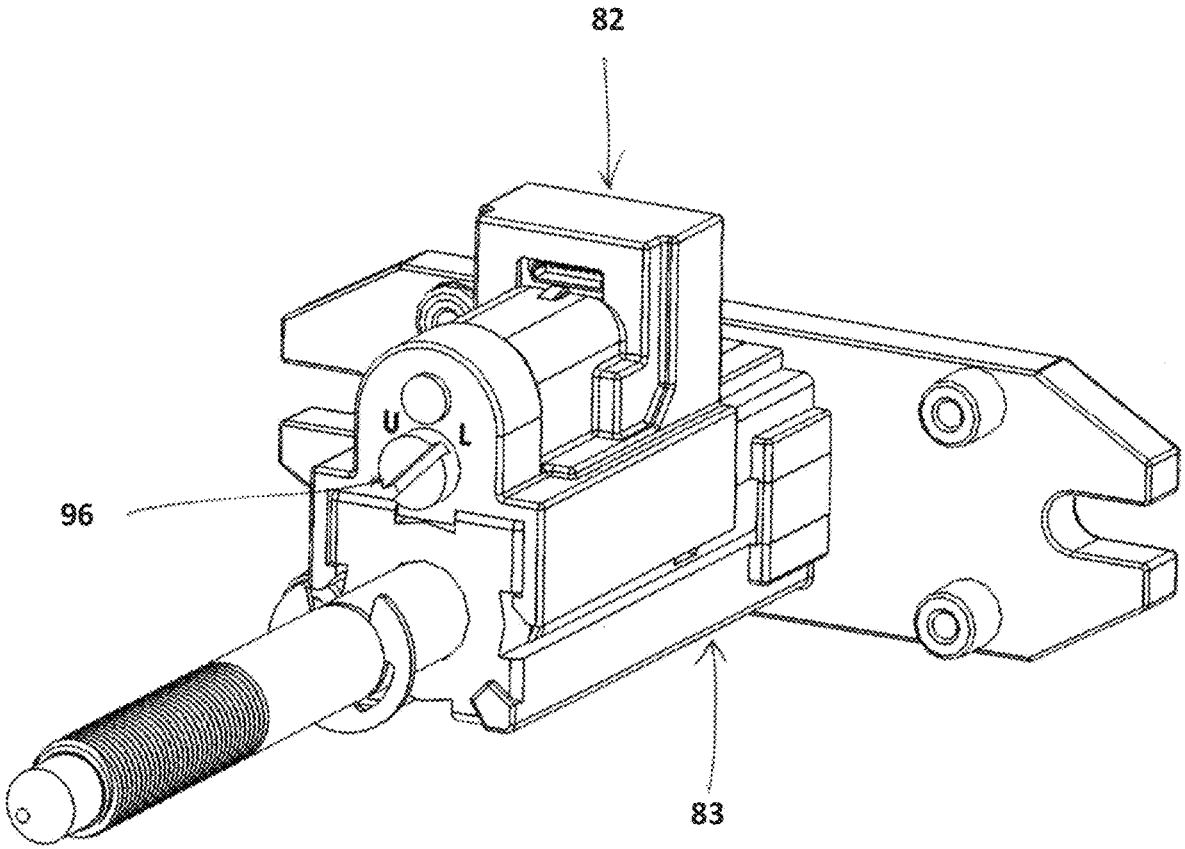
FIG. 25 is a perspective drawing of an aspect of an electronic-control T-Handle in accordance with an embodiment of the invention.

In this embodiment, the installer would apply the MCU 82 by sliding the MCU 82 on the pre-existing housing at for example the 12:00 position as shown in FIG. 24. MCU 82 slides on housing 83 and seats until the rear end of MCU 82 is flush with the rear end of housing 83 and fastened by fastener 96 as shown in FIG. 25. The installer would fasten the MCU to the housing by turning fastener 96 thereby fastening the MCU to the housing. The MCU 82 can be fastened by fastener 96 with a tool at the rear of the housing as shown, and/or the MCU can also be fastened by a fastener on the inside of the housing with a tool that travels inside the housing to reach the fastener.

Figure 26:
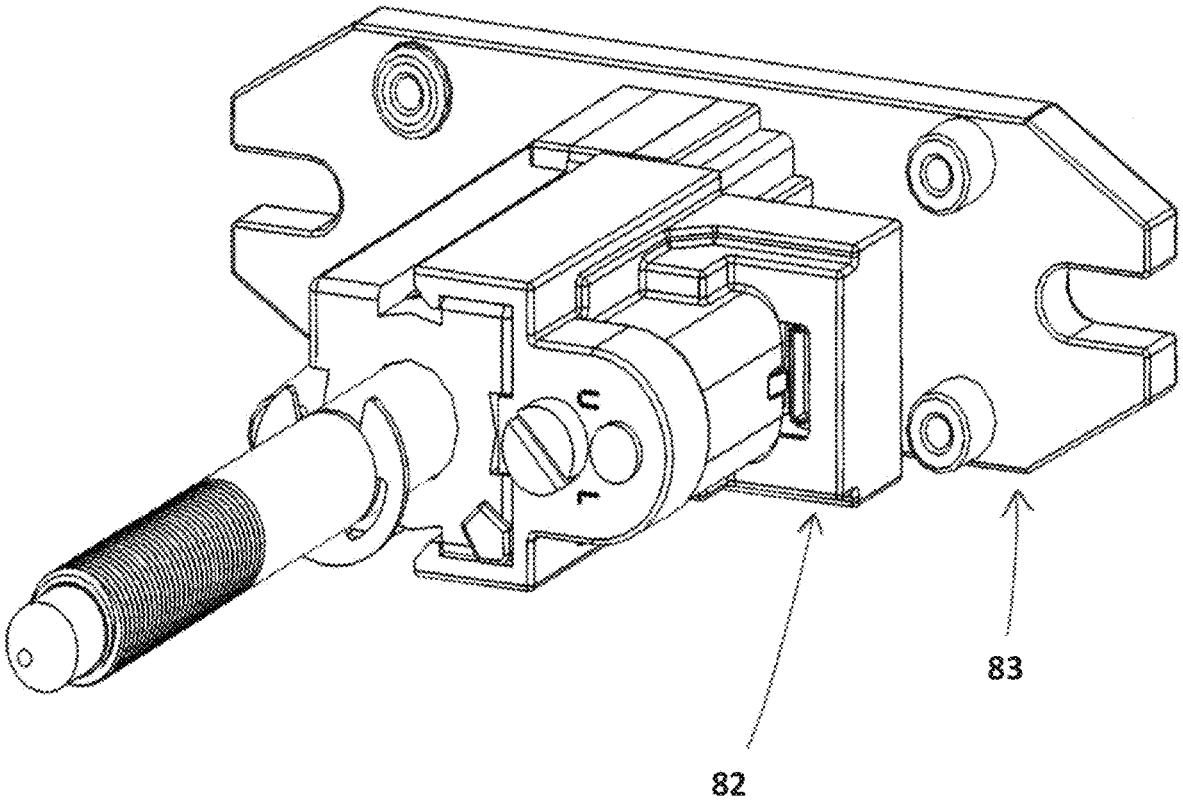
FIG. 26 is a perspective drawing of an aspect of an electronic-control T-Handle in accordance with an embodiment of the invention.

It will be appreciated that the MCU 82 can also be installed at the 3:00, 6:00 or 9:00 positions; position 3:00 is shown by way of example in FIG. 26. Again, the fastener 96 can be operated by a tool inserted into the head of the fastener, such as a flathead screw, or the fastener head can be inside the MCU 82 and operated by inserting the tool into the front of the housing to operate the fastener head after the MCU is seated on the housing.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A wireless lock assembly for selectively locking and unlocking a handle positionable in a housing, the assembly comprising:

a locking element, selectively positionable between a lowered position and a raised position, for selectively locking the handle in the housing; and an electronically controlled locking mechanism, selectively positionable in a set lock position, a set unlock position and a set latch permitting position, for selectively controlling movement of the locking element;

wherein the locking mechanism includes a blocking portion to prevent movement of the locking element away from the lowered position toward the raised position when the locking mechanism is in its lock position;

wherein the locking element is biased to the lowered position by a biasing element providing a biasing force when the locking mechanism is in the set latch permitting position, and wherein the locking mechanism while in the set latch permitting position is adapted to permit movement of the locking element from the lowered position against the biasing force.

2. A wireless lock assembly for selectively locking and unlocking a handle positionable in a housing, the assembly comprising:

a locking element, selectively positionable between a lowered position and a raised position, for selectively locking the handle in the housing;

an electronically controlled locking mechanism, selectively positionable in a set lock position, a set unlock position and a set latch permitting position, for selectively controlling movement of the locking element;

wherein the locking mechanism includes a blocking portion to prevent movement of the locking element away from the lowered position toward the raised position when the locking mechanism is in its lock position; and a wireless signal receiver circuit for controlling the locking mechanism.

3. The wireless lock assembly of claim 2, further comprising at least one sensor for sensing the position of the handle.

4. The wireless lock assembly of claim 2, further comprising at least one sensor for sensing the position of the locking mechanism.

5. The wireless lock assembly of claim 2, wherein the locking mechanism is a motorized cam.

6. A wireless lock assembly for selectively locking and unlocking a handle positionable in a housing, the assembly comprising:

a locking element, selectively positionable between a handle interference position and a handle non-interference position, for selectively locking the handle in the housing; and an electronically controlled locking mechanism, selectively positionable in a first set position, a second set position and a third set position, for selectively controlling movement of the locking element;

wherein when the locking mechanism is in the first set position, the locking element is in the handle interference position in engagement with the handle, and the locking mechanism prevents movement of the locking element out of the handle interference position toward the handle non-interference position via a blocking portion of the locking mechanism;

wherein when the locking mechanism is in the second set position, the locking element is in the handle non-interference position out of engagement with the handle via a lifting portion of the locking mechanism;

wherein when the locking mechanism is in the third set position, the locking element is biased to the handle interference position by a biasing element providing a biasing force, and the locking mechanism is adapted to permit movement of the locking element out of the handle interference position against the biasing force; and a wireless signal receiver circuit for controlling the locking mechanism.

7. The wireless lock assembly of claim 6, further comprising at least one sensor for sensing the position of the handle.

8. The wireless lock assembly of claim 6, further comprising at least one sensor for sensing the position of the locking mechanism.

9. The wireless lock assembly of claim 6, wherein the locking mechanism is a motorized cam.

10. An electronically controlled lock assembly for selectively locking and unlocking a handle having a latch operatively connected thereto, the assembly comprising:

a locking element operatively mounted adjacent to the handle and being selectively engageable with the handle so as to selectively lock the latch, wherein the locking element is selectively positionable between a biased and moveable position, an interfering and non-movable position and a non-interfering and non-moveable position;

a locking mechanism, selectively positionable in a set lock position, a set unlock position and a set latch position, for selectively controlling movement of the locking element; and a controller for detecting the positions of the locking element;

wherein when the locking mechanism is in its set lock position, the locking element is in its interfering and non-movable position;

wherein when the locking mechanism is in its set unlock position, the locking element is in its non-interfering and non-moveable position; and wherein when the locking mechanism is in its set latch position, the locking element is in its biased and moveable position.

11. A wireless lock assembly for selectively locking and unlocking a handle positionable in a housing, the assembly comprising:

a locking element, selectively positionable between a lowered position and a raised position, for selectively locking the handle in the housing; and an electronically controlled locking mechanism, selectively positionable in a set lock position, a set unlock position and a set latch permitting position, for selectively controlling movement of the locking element;

wherein the locking mechanism includes a blocking portion to prevent movement of the locking element away from the lowered position toward the raised position when the locking mechanism is in its lock position;

wherein the locking element and the locking mechanism are operatively mounted adjacent to the housing and external of the handle.

12. A wireless lock assembly for selectively locking and unlocking a handle positionable in a housing, the assembly comprising:

a locking element, selectively positionable between a handle interference position and a handle non-interference position, for selectively locking the handle in the housing; and an electronically controlled locking mechanism, selectively positionable in a first set position, a second set position and a third set position, for selectively controlling movement of the locking element;

wherein when the locking mechanism is in the first set position, the locking element is in the handle interference position in engagement with the handle, and the locking mechanism prevents movement of the locking element out of the handle interference position toward the handle non-interference position via a blocking portion of the locking mechanism;

wherein when the locking mechanism is in the second set position, the locking element is in the handle non-interference position out of engagement with the handle via a lifting portion of the locking mechanism; and wherein when the locking mechanism is in the third set position, the locking element is biased to the handle interference position by a biasing element providing a biasing force, and the locking mechanism is adapted to permit movement of the locking element out of the handle interference position against the biasing force;

wherein the locking element and the locking mechanism are operatively mounted adjacent to the housing and external of the handle.

* * * * *